US006467190B2

(12) United States Patent
Nagel et al.

(10) Patent No.: US 6,467,190 B2
(45) **Date of Patent: *Oct. 22, 2002**

(54) DRYING KILN

(75) Inventors: Robert T. Nagel, Raleigh, NC (US); John Craig Holbert, Corvallis, OR (US)

(73) Assignee: George R. Gulp, New London, NC (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/532,493

(22) Filed: Mar. 22, 2000

(65) Prior Publication Data

US 2002/0108266 A1 Aug. 15, 2002

(51) Int. Cl.[7] ..... F26B 19/00

(52) U.S. Cl. ..... 34/218; 34/221; 34/229; 432/103

(58) Field of Search ..... 34/307, 396, 406, 34/403, 508, 518, 216, 218, 221, 229, 231; 432/33, 66, 88, 103, 144, 145, 199; 110/346, 229, 234

(56) References Cited

U.S. PATENT DOCUMENTS

| | | | |
|---|---|---|---|
| 217,022 | A | 7/1879 | Robbins |
| 528,496 | A | 10/1894 | Williams |
| 942,150 | A | 12/1909 | Tiemann |

(List continued on next page.)

FOREIGN PATENT DOCUMENTS

| | | | |
|---|---|---|---|
| CA | 699870 | 12/1964 | |
| DE | 3321-673 | 6/1983 | |
| DE | 3321-673 A | 12/1984 | |
| SU | 901772 | 2/1982 | |

OTHER PUBLICATIONS

George R. Culp et al., U.S. Patent Appli. No. 09/653,625, filed Sept. 1, 2000.

*Primary Examiner*—Pamela Wilson
(74) *Attorney, Agent, or Firm*—Alston & Bird LLP

(57) ABSTRACT

A duct system includes an upper duct that supplies heated air to an upper plenum and a lower duct that supplies heated air to a lower plenum, and the upper and lower plenums provide the heated air to a kiln chamber. An intermediate plenum is between the upper and lower plenums and has outlets through which heated air supplied to the upper and lower plenums is discharged. A plurality of circulation passages extend generally laterally through the intermediate plenum. Fans positioned in the circulation passages circulate heated air that is external to the plenums. The outlets are nozzles defining discharge axes that are respectively directed generally parallel to, yet slightly toward, the rotational axes of the fans. Tips of the fans' blades extend into boundary layers adjacent the interior surfaces of the circulation passages. The fans operate in first and second modes to respectively force flow in opposite first and second directions. Heated air is supplied from the intermediate plenum to the high-pressure sides of the fans. The plenums together generally define an I-like shape in an in an end elevation view thereof. Constrictions are defined proximate the low-pressure sides of the fans and an expansions are defined proximate the high-pressure sides of the fans. A flange-equipped lower wall of the lower plenum extends beyond the edges of a charge of lumber positioned thereunder for drying. The intermediate and lower plenums are telescopically movable with respect to one another. The lower plenum is lowered onto walls that extend upward from a slab, and enclosing structures are mounted to the upper plenum.

39 Claims, 10 Drawing Sheets

U.S. PATENT DOCUMENTS 1,039,301 A 9/1912 Leaver
1,054,597 A 2/1913 Moore
1,108,377 A 8/1914 Leaver
1,268,180 A 6/1918 Tiemann
1,276,979 A 8/1918 Sidman
1,366,225 A 1/1921 Weiss
RE15,316 E 3/1922 Weiss
1,432,248 A 10/1922 Hirt
1,461,393 A 7/1923 Jenkinson
1,467,306 A 9/1923 Carrier
1,539,817 A 5/1925 Thelen
1,543,344 A 6/1925 Thelen
1,594,549 A 8/1926 Noel
1,603,103 A 10/1926 Anderson
1,693,395 A 11/1928 Lawton
1,774,208 A 8/1930 Mueller
1,778,586 A 10/1930 Cobb
1,833,397 A 11/1931 Hagen
1,840,523 A 1/1932 Mueller
1,919,646 A 7/1933 Woolhouse
1,964,115 A 6/1934 Goodall
1,989,998 A 2/1935 Mueller
1,995,675 A 3/1935 Furbush
2,001,001 A 5/1935 Thelen
2,006,018 A 6/1935 Goodall
2,081,098 A 5/1937 Steel
2,085,634 A 6/1937 Cobb
2,318,027 A 5/1943 Sykes et al.
2,380,518 A 7/1945 Gottschalk et al.
2,538,888 A 1/1951 Smith
2,718,713 A 9/1955 Bloxham
2,736,108 A 2/1956 Muyderman
2,821,029 A 1/1958 Simons
2,825,274 A 3/1958 Kurth et al.
3,129,071 A 4/1964 Meredith
3,149,932 A 9/1964 Bachrich
3,337,967 A 8/1967 Smith
3,355,783 A 12/1967 Miller et al.
3,363,324 A 1/1968 Martin
3,367,040 A 2/1968 Vani
3,386,186 A 6/1968 Tiefenbach
3,417,486 A 12/1968 Vanicek
3,584,395 A 6/1971 Peters
3,659,352 A 5/1972 Cook
3,675,600 A 7/1972 Jones
3,680,219 A 8/1972 Koch
3,716,004 A 2/1973 Jones
3,757,428 A 9/1973 Runciman
3,808,703 A 5/1974 Kamiya
3,899,836 A 8/1975 Johnson
3,932,946 A 1/1976 Johnson
4,014,107 A 3/1977 Bachrich
4,098,008 A 7/1978 Schuette et al.
4,182,049 A 1/1980 Lestraden
4,250,629 A 2/1981 Lewis
4,343,095 A 8/1982 Rosen et al.
4,344,237 A 8/1982 Willington
4,380,877 A 4/1983 Poux
4,556,043 A 12/1985 Bratton
4,662,083 A 5/1987 Carter et al.
4,663,860 A 5/1987 Beall
4,683,668 A 8/1987 Hondzinski et al.
4,753,020 A 6/1988 Brunner
4,862,599 A 9/1989 Brunner
4,955,146 A 9/1990 Bollinger
4,972,604 A 11/1990 Breckenridge
5,107,607 A 4/1992 Mason
5,195,251 A 3/1993 Gyurcsek et al.
5,226,244 A 7/1993 Carter et al.
5,276,980 A 1/1994 Carter et al.
5,414,944 A 5/1995 Culp et al.
5,416,985 A 5/1995 Culp
5,437,109 A 8/1995 Culp
5,488,785 A 2/1996 Culp
6,219,937 B1 * 4/2001 Culp et al. ..... 34/396

* cited by examiner

DRYING KILN

FIELD OF THE INVENTION

The present invention relates generally to the drying of green lumber in a kiln and, more particularly, to kilns and kiln-related structures, and associated methods.

BACKGROUND OF THE INVENTION

Lumber which has recently been cut contains a relatively large percentage of water and is referred to as green lumber. Prior to being used in construction or other applications which demand good grades of lumber, the green lumber must be dried. Drying removes a large amount of water from the lumber and significantly reduces the potential for the lumber to become warped or cracked. Acceptable water content varies depending on the use of the lumber and type of wood; however, a moisture content of about nineteen percent, or less, is acceptable in many circumstances.

Although lumber may be dried in the ambient air, kiln drying accelerates and provides increased control over the drying process. In kiln drying, a charge of lumber is placed in a kiln chamber. The charge of lumber typically consists of one or more rectangular stacks of lumber. A typical kiln chamber is a generally rectangular building that can be at least partially sealed to control the amount of air that is introduced to and exhausted from the kiln chamber. Further, such kiln chambers typically have reversible fans for circulating heated air through the chamber. The air may be heated in a number of ways, such as by a suspension furnace that exhausts hot air into the kiln chamber, or by heat transfer from steam-carrying pipes that extend through the chamber.

The cost of constructing a kiln adds to the cost of producing quality lumber. Likewise, operating the furnace and fans of a kiln consumes energy that adds to the cost of producing quality lumber. Of course it is advantageous to lower the cost of producing quality lumber. In addition, mill production depends upon the ability to dry lumber at a sufficient rate so that production need not be slowed to allow for the drying process. Whereas some conventional kilns can be characterized as being efficiently constructed and operated and able to dry lumber at a sufficient rate, there is always a demand for new kilns and kiln-related structures that can be even more efficiently constructed and operated, and that facilitate the drying of lumber at a sufficient rate.

SUMMARY OF THE INVENTION

The present invention includes numerous different aspects that are related to, but not necessarily limited to, efficiently constructing and operating kilns, and drying lumber at a sufficient rate so that mill production need not be slowed to allow for the drying process. A kiln of one embodiment of the present invention includes a kiln chamber defining a chamber interior space. A lower portion of the kiln chamber defines a lower portion of the chamber interior space that includes a charge-receiving space for receiving a charge of lumber for drying. An upper portion of the kiln chamber defines an upper portion of the chamber interior space. The kiln also includes a plenum that is at least partially positioned in the upper portion of the chamber interior space and is capable of receiving heated air from a furnace and supplying heated air to the chamber interior space. In addition, the kiln can include one or more air moving devices to circulate the heated air supplied to the chamber interior space through a charge of lumber positioned in the charge-receiving space.

In accordance with one aspect of the present invention, the plenum is a composite plenum that includes a lower plenum and an upper plenum positioned above the lower plenum. The kiln can also include a duct system that provides heated air from the furnace to the composite plenum, and outlets from the composite plenum that discharge heated air to the upper portion of the chamber interior space. More specifically, the duct system includes an upper duct that provides heated air to the upper plenum, and a lower duct that provides heated air to the lower plenum, which facilitates balanced flow.

In accordance with another aspect of the present invention, the composite plenum includes an intermediate plenum positioned between and in communication with both the upper and lower plenums, and the outlets from the composite plenum open into the intermediate plenum. Heated air that is discharged by the outlets flows into the intermediate plenum from both the upper and lower plenums.

In accordance with another aspect of the present invention, the composite plenum has opposite ends and extends in a longitudinal direction between the ends, and the intermediate plenum includes opposite longitudinally extending first and second sides that are displaced from one another in a lateral direction that is generally perpendicular to the longitudinal direction. A plurality of circulation passages extend generally laterally through the intermediate plenum. Each circulation passage defines opposite open ends that are open to the chamber interior space and are respectively proximate the laterally opposite sides of the plenum. Each of the circulation passages defines an interior space that is discontiguous with the interior space of the composite plenum, so the circulation passages do not function as outlets from the interior space of the composite plenum. Each air moving device includes an impeller positioned in a respective circulation passage, and each impeller defines a rotational axis. The air moving devices cooperate to provide a recirculating flow path that extends through the circulation passages and the lower portion of the chamber interior space, including the charge-receiving space. Air flows in a first direction along the recirculating flow path while the air moving devices operate in a first mode. Air flows in an opposite second direction along the recirculating flow path while the air moving devices operate in a second mode.

In accordance with another aspect of the present invention, each impeller defines a rotational axis and includes a plurality of blades extending radially away from the rotational axis, and each blade has a blade tip that is distant from the rotational axis. Each circulation passage has an interior surface that extends around the rotational axis of the impeller within the circulation passage. Each air moving device is capable of being operated to form a flow-induced boundary layer adjacent the interior surface of its respective circulation passage. Each air moving device and its circulation passage are constructed so that the blade tips extend at least to, and preferably into, the flow-induced boundary layer while the air moving device is operated, so that undesirable bypass flow proximate the blade tips is restricted.

In accordance with another aspect of the present invention, the outlets from the composite plenum that introduce heated air to the upper portion of the chamber interior space are operated so that heated air is supplied only to the high-pressure side of the air moving devices during both the first and second modes of operation.

In accordance with another aspect of the present invention, the outlets provide jet-like flow and define discharge axes. All of the discharge axes are directed at least generally parallel to the rotational axes of the impellers so that the jet-like flow augments the flow from the impellers. In accordance with one embodiment, at least some of the discharge axes have a slight tilt toward rotational axes of the impellers, which promotes mixing.

In accordance with another aspect of the present invention, the composite plenum includes multiple protrusions so that in an end elevation view the composite plenum generally defines an I-like shape. The rotational axes of the air moving devices extend generally in a common horizontal plane, and the protrusions are paired and extend divergently away from the plane to define a constriction to the recirculating flow path on the low-pressure sides of the air moving devices, and to define an expansion to the recirculating flow path on the high-pressure sides of the air moving devices. In accordance with another aspect of the present invention, each of the circulation passages also defines a constriction proximate the low-pressure side of the impeller therein, and an expansion proximate the high-pressure side of the impeller therein. These constrictions and expansions optimize the operation of the air moving devices.

In accordance with another aspect of the present invention, a lower wall of the lower plenum has opposite and longitudinally extending upstream and downstream edges that are displaced from one another in the lateral direction. The upstream edge of the lower wall of the lower plenum extends laterally beyond the upstream side of the charge-receiving space, and the downstream edge of the lower wall of the lower plenum extends laterally beyond the downstream side of the charge-receiving space. As a result, in a bottom plan view the entire charge-receiving space is positioned between the upstream and downstream edges of the lower wall of the lower plenum. As a result, flow respectively into and out of upper portions of the upstream and downstream sides of a charge of lumber is advantageously controlled by the lower wall of the lower plenum. In accordance with another aspect of the present invention, these flows are further respectively controlled by a longitudinally extending, concave, upstream flange that is proximate the upstream edge of the lower wall of the lower plenum and a longitudinally extending, concave, downstream flange that is proximate the downstream edge of the lower wall of the lower plenum.

In accordance with another aspect of the present invention, the composite plenum defines an interior space that is relatively large. For example, in accordance with one example, the volume of the composite plenum is at least approximately equal to the volume of the charge of lumber dried in the kiln chamber. As a result, flow-related losses within the composite plenum can be limited.

In accordance with another aspect of the present invention, the kiln has a modular design. For example, the intermediate and lower plenums are telescopically movable with respect to one another between extended and collapsed configurations. As such, the composite plenum, which can be quite large once fully assembled, can be transported in a more compact fashion.

In accordance with another aspect of the present invention, the kiln is at least partially constructed by lowering the composite plenum onto first and second walls that extend upward from a slab so that the composite plenum extends generally between the first and second walls, the composite plenum is supported by the first and second walls, and the composite plenum is suspended above the slab. An enclosing structure is mounted to the composite plenum to at least partially form the upper chamber portion of the kiln chamber. Thus, the composite plenum and the first and second walls effectively serve as the superstructure that supports a substantial portion of the remainder of the kiln chamber.

These and other aspects of the present invention are advantageous because they each pertain to either the efficient construction, efficient operation, or timely operation of kilns.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
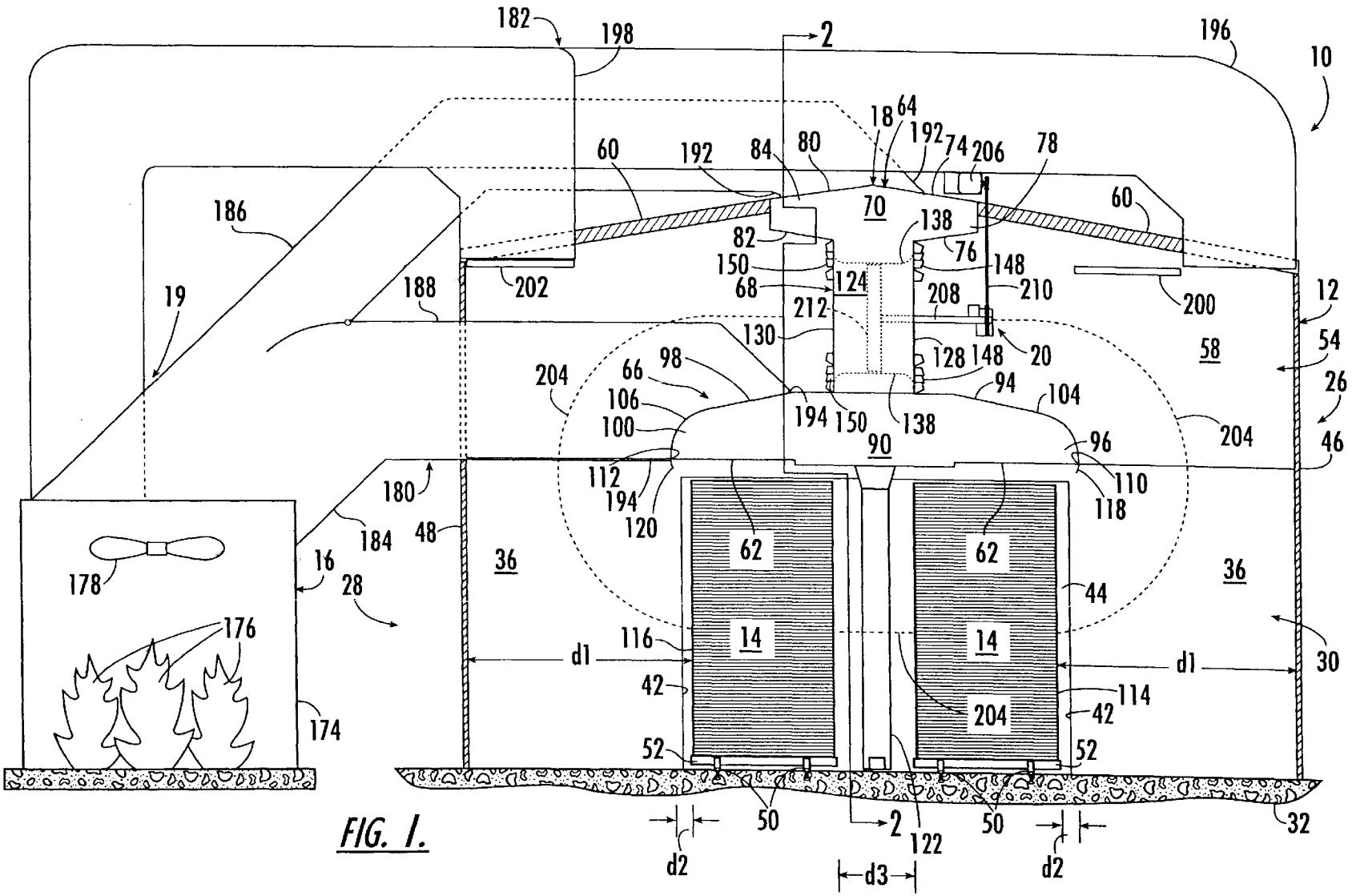
FIG. 1 is a schematic, front end, partially cross-sectional view of a kiln, in accordance with one embodiment of the present invention.

A kiln 10 of one embodiment of the present invention is schematically illustrated in FIG. 1, which is a partially cross-sectional front view. The operation of the kiln 10 of the illustrated embodiment of the present invention will initially be very generally described. The very general description will be followed by separate sections that respectively describe details about structures of the kiln 10, assembly of the kiln, and some exemplary operational aspects of the kiln. Some aspects of the present invention are described without regard to the sections, and the use of the sections is not intended to limit the scope of the present invention.

Figure 2:
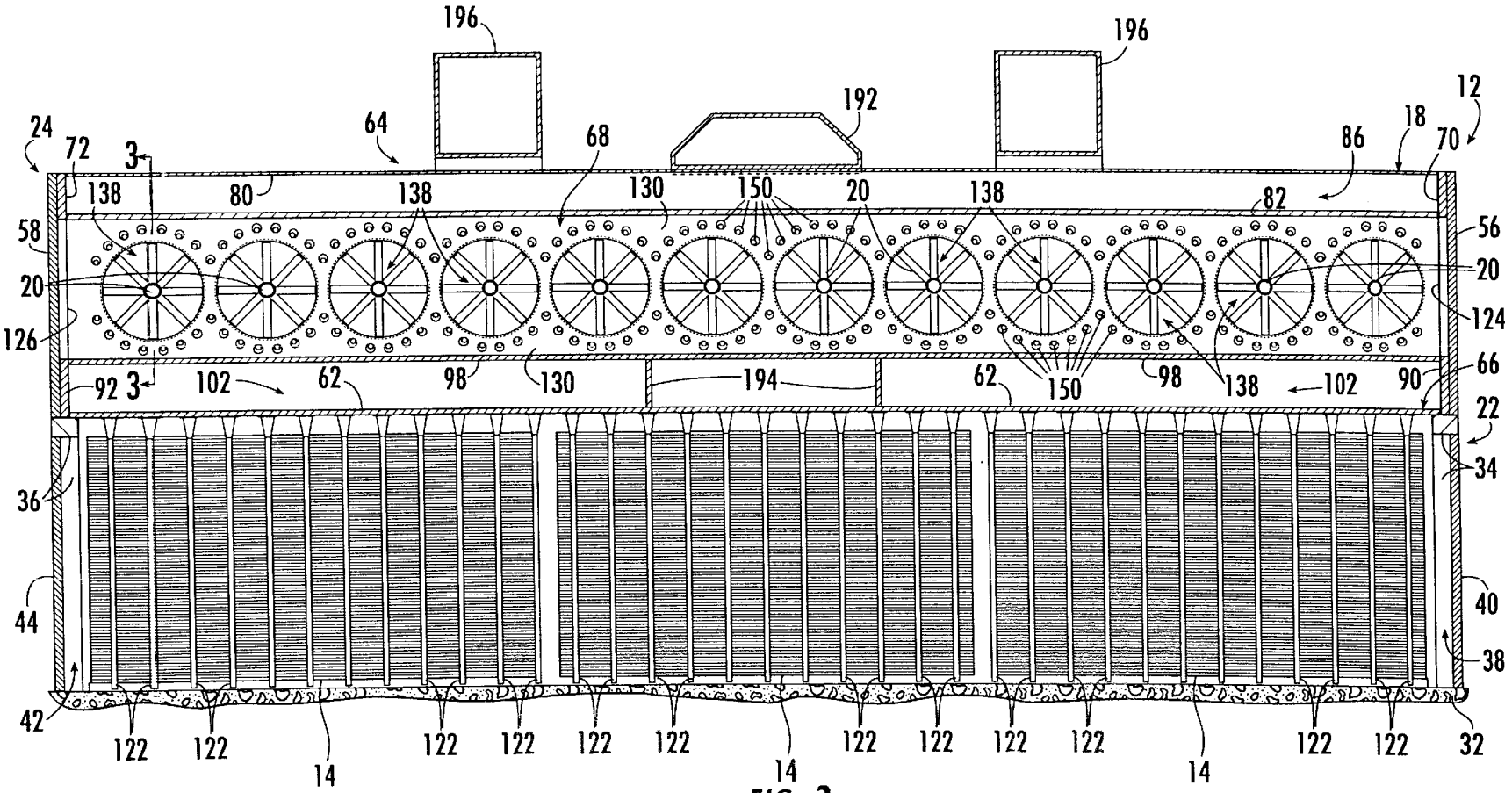
FIG. 2 is a schematic, left side, cross-sectional view of a kiln chamber of the kiln of FIG. 1, wherein the view includes some of the items closely connected to or contained by the kiln chamber, and the cross-section is substantially along line 2—2 of FIG. 1.

The kiln 10 includes a kiln chamber 12 that receives a charge 14 of lumber. The kiln 10 further includes a furnace, such as a suspension furnace 16, or the like, and a communication system that routes heated air from the furnace to the kiln chamber 12 to dry the charge 14 of lumber. The communication system includes a plenum that can be characterized as a composite plenum 18 and a duct system 19 that communicates at least between the furnace 16 and the composite plenum. The kiln chamber 12 and some of the items closely connected to or contained by the kiln chamber are schematically illustrated in FIG. 2, which is a cross-sectional view taken substantially along line 2—2 of FIG. 1. Multiple air moving devices, such as a series of fans 20, are operated to circulate the heated air within the kiln chamber 12 and enhance the drying of the charge 14 of lumber. Only a few of the fans 20 are specifically identified by their reference numeral in FIG. 2.

Structures of the Kiln

As best understood with reference to FIGS. 1 and 2, the kiln chamber 12 includes opposite front and rear ends 22, 24 and opposite right and left sides 26, 28. The kiln chamber 12 defines a chamber interior space that receives the charge 14 of lumber and is heated by the furnace 16. The kiln chamber 12 includes a lower chamber portion that defines a lower portion of the chamber interior space 30. The lower chamber portion includes a slab 32 and load-bearing front and rear walls 34, 36 that extend generally vertically upward from and are carried by the slab. The front wall 34 defines a front door opening 38 therethrough and carries front doors 40, typically in a pivotal or slideable fashion, that are used to open and close the front door opening. Similarly, the rear wall 36 defines a rear door opening 42 therethrough and carries rear doors 44, also typically in a pivotal or slideable fashion, that that are used to open and close the rear door opening. The lower chamber portion further includes lower portions of right and left side walls 46, 48. It should be apparent, however, that the lumber can be loaded and unloaded through the same set of doors such that only one of the front and rear walls includes doors, or alternatively the doors could be in one or both side walls, if so desired.

A transportation system is provided for moving a charge 14 of lumber into the lower portion of the chamber interior space 30, such as through the front door opening 38, for drying, and thereafter out of the lower portion of the chamber interior space, such as through the rear door opening 42. As illustrated in FIG. 1, the transportation system includes two sets of tracks 50 upon which wheeled carriages 52 travel. The tracks 50 extend longitudinally across the slab 32 and through the lower portion of the chamber interior space 30, the front door opening 38, and the rear door opening 42. Each wheeled carriage 52 carries a stack of lumber. The transportation system at least partially defines a charge-receiving space within the lower portion of the chamber interior space 30. The charge-receiving space is the space that is occupied by the charge 14 of lumber in FIGS. 1 and 2. A distance "d1" is defined between each of the right and left side walls 46, 48 and the charge-receiving space. In accordance with one particular example, the distances "d1" are each preferably at least approximately 12.75 feet.

As is additionally illustrated in FIG. 1, the right and left stacks of lumber, which can be characterized as respectively occupying and defining a right stack-receiving space and a left stack-receiving space, are generally spaced apart, such as by a distance "d3". In accordance with one particular example, the distance "d3" is approximately 4.5 feet. In accordance with one particular example, each of the right and left stack-receiving spaces defines a volume of approximately 5,341.25 cubic feet, such that the total volume of the lumber load is approximately 10,682.5 cubic feet.

In accordance with the illustrated embodiment of the present invention, a charge 14 includes six stacks of lumber. However, the kiln 10 is scaleable and in accordance with one embodiment of the present invention a smaller kiln is provided for which a charge includes a single stack of lumber. That is, kilns of various sizes are within the scope of the present invention. For example, kilns that are sufficiently small can include only a single fan and corresponding reduced numbers of other components of the illustrated embodiment.

The kiln chamber 12 also includes an upper chamber portion that is positioned above the lower chamber portion. The upper chamber portion defines an upper portion of the chamber interior space 54 that is positioned above the lower portion of the chamber interior space 30 and at least partially contains the composite plenum 18. The upper chamber portion includes upper portions of the right and left side walls 46, 48, an upper front wall 56, an upper rear wall 58, and a roof 60. The boundary between the upper and lower chamber portions is not necessarily associated with a precise location, but rather the upper and lower chamber portions are described to provide a frame of reference that aids in the description of the kiln chamber 12. Nonetheless, in accordance with the illustrated embodiment of the present invention, a generally horizontally extending lower wall 62 of the composite plenum 18 can be characterized as defining the boundary between the upper and lower portions of the chamber interior space 54, 30.

The composite plenum 18 includes opposite front and rear ends respectively positioned at the front and rear ends 22, 24 of the kiln chamber. The composite plenum 18 extends in a longitudinal direction between its front and rear ends. The front and rear ends of the lower wall 62 of the composite plenum 18 are respectively positioned upon the load-bearing front and rear walls 34, 36. The front and rear walls 34, 36 together bear the entire weight of the composite plenum 18 and the components carried by the composite plenum, in accordance with the illustrated embodiment of the present invention.

The composite plenum 18 is described herein as including an upper plenum 64, a lower plenum 66, and an intermediate plenum 68, each of which can be characterized as being a distinct part or section of the composite plenum. It is within the scope of the present invention for the composite plenum 18 to be characterized as being a non-composite component.

Nonetheless, for the sake of explanation is useful to identify the sum of the upper, lower, and intermediate plenums 64, 66, 68 as the composite plenum or as a plenum system, or the like.

The upper plenum 64 includes generally vertically extending, opposite front and rear walls 70, 72, as well as upper and lower right walls 74, 76 that cooperate to define a deck-like right protrusion 78 that extends longitudinally between the front and rear walls of the upper plenum. Likewise, upper and lower left walls 80, 82 cooperate to define a deck-like left protrusion 84 that extends longitudinally between the front and rear walls 70, 72 of the upper plenum 64. All of the walls 70, 72, 74, 76, 80, 82 of the upper plenum 64 at least partially bound and define an upper plenum cavity 86. For example, the upper plenum cavity 86 extends into the right and left protrusions 78, 84 of the upper plenum 64. Walls of the upper plenum 64 also define a longitudinally and horizontally extending, downward-oriented interplenum opening 88 that is open to the upper plenum cavity 86 and is illustrated by broken lines in FIG. 3. The upper plenum cavity 86 and the downward-oriented interplenum opening 88 extend generally for the entire longitudinal length of the upper plenum 64. The upper plenum 64, including the upper plenum cavity 86 and the downward-oriented interplenum opening 88, is generally uniform along the length of the upper plenum (that is, in the longitudinal direction). The upper plenum cavity 86 can contain one or more longitudinally extending baffle plates (not shown) that are operative to restrict any undesired flow characteristics of the heated air within the upper plenum 64.

The lower plenum 66 includes generally vertically extending, opposite front and rear walls 90, 92. The lower wall 62 that generally separates the lower and upper portions of the chamber interior space 30, 54 is part of the lower plenum 66 and extends longitudinally between the front and rear walls 90, 92 of the lower plenum. The lower plenum 66 further includes a right wall 94 that cooperates with the lower wall 62 to provide a front deck-like right protrusion 96 that extends longitudinally between the front and rear walls 90, 92 of the lower plenum. Likewise, a left wall 98 cooperates with the lower wall 62 to provide a deck-like left protrusion 100 that extends longitudinally between the front and rear walls 90, 92 of the lower plenum 66. In an end elevation view the composite plenum 18 generally defines an I-like shape due to the protrusions 78, 84, 96, 100.

All of the walls 62, 90, 92, 94, 98 of the lower plenum 66 at least partially bound and define a lower plenum cavity 102. For example, the lower plenum cavity 102 extends into the right and left protrusions 96, 100. The right wall 94 defines a right radius of curvature 104, and the left wall 98 defines a left radius of curvature 106. Walls of the lower plenum 66 also define a longitudinally and horizontally extending, upward-oriented interplenum opening 180 that is open to the lower plenum cavity 102 and is illustrated by broken lines in FIG. 3. The lower plenum cavity 102 and the upward-oriented interplenum opening 108 extend generally for the entire longitudinal length of the lower plenum 66. Further, the lower plenum 66, including the lower plenum cavity 102 and upward-oriented interplenum opening 108, is generally uniform along the longitudinal length of the lower plenum. The lower plenum cavity 102 can contain one or more longitudinally extending baffle plates (not shown) that are operative to restrict any undesired flow characteristics of the heated air within the lower plenum 66.

The lower wall 62 of the lower plenum 66 includes longitudinally extending right and left edges 110, 112 that extend longitudinally between the front and rear walls 90, 92 of the lower plenum. The right and left edges 110, 112 are spaced apart from one another in a lateral direction that is generally perpendicular to the longitudinal direction. The right edge 110 of the lower wall 62 extends laterally beyond a right side 114 of the charge-receiving space by a distance "d2". Likewise, the left edge 112 of the lower wall 62 extends laterally beyond a left side 116 of the charge-receiving space by a distance "d2". The distances "d2" are each preferably at least approximately one foot. A longitudinally extending right flange 118 is connected to the lower wall 62 proximate the right edge 110. The right flange 118 hangs downward from the lower wall 62 and is generally concave when viewed from the charge-receiving space. Similarly, a longitudinally extending left flange 120 is connected to the lower wall 62 proximate the left edge 112. The left flange 120 hangs downward from the lower wall 62 and is generally concave when viewed from the charge-receiving space. As shown in FIG. 1, the lower plenum 66 is typically larger than the upper plenum 64 since the lower plenum also serves to direct air about the upper right and left comers of the charge 14 of lumber, as will be discussed in greater detail below. However, the upper and lower plenums 64, 66 can have the same general size, if so desired.

As illustrated in FIGS. 1–2, multiple lower outlets, which are preferably in the form of reheater conduits 122, are mounted to the lower wall 62 of the lower plenum 66. Only a representative few of the reheater conduits 122 are identified by their reference numeral in FIG. 2. The reheater conduits 122 direct heated air from the lower plenum cavity 102 to the lower portion of the chamber interior space 30. Each reheater conduit 122 defines a series of vertically spaced apart apertures (not shown) along its length that provide communication paths to the lower portion of the chamber interior space 30. As best understood with reference to FIG. 1, the reheater conduits 122 are centered between the right and left stack-receiving spaces.

Figure 3:
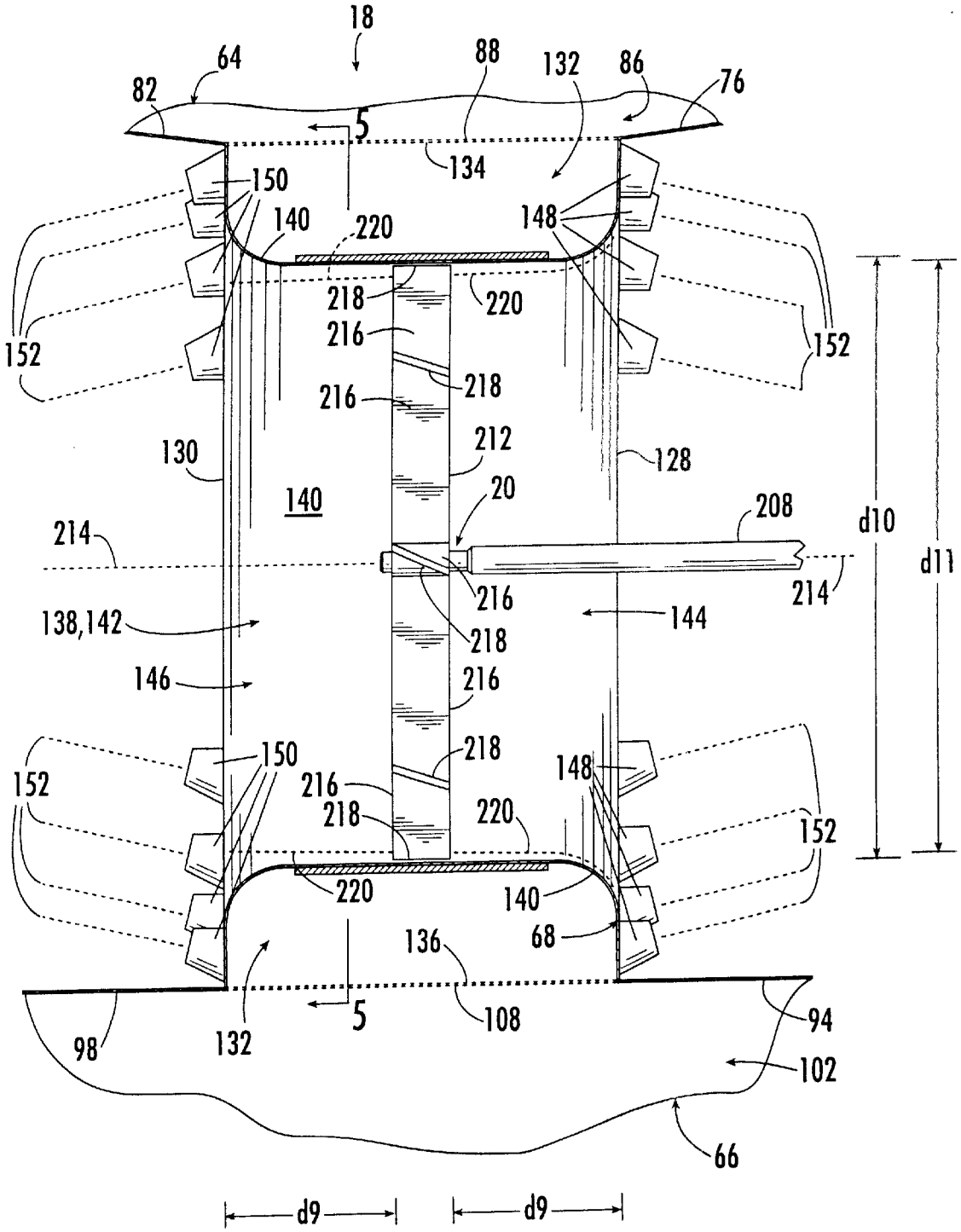
FIG. 3 is a schematic, partial, cross-sectional view taken substantially along line 3—3 of FIG. 2, and illustrating portions of the kiln of FIG. 1, including portions of a composite plenum, a portion of a representative circulation passage extending through an intermediate plenum of the composite plenum, a portion of a representative fan, and representative nozzles-like outlets associated with the composite plenum.

The intermediate plenum 68 includes generally vertically extending, opposite front and rear walls 124, 126. The intermediate plenum 68 also includes generally vertically and longitudinally extending, opposite right and left walls 128, 130 that are laterally spaced apart from one another and extend between the front and rear walls 124, 126. All of the walls 124, 126, 128, 130 of the intermediate plenum 68 at least partially bound and define an intermediate plenum cavity 132 (FIG. 3). Walls of the intermediate plenum also define horizontally and longitudinally extending upward-oriented and downward-oriented interplenum openings 134, 136, both of which are illustrated by broken lines in FIG. 3. The intermediate plenum cavity 132 and the interplenum openings 134, 136 extend generally for the entire longitudinal length of the intermediate plenum 68. The interplenum openings 134, 136 are generally uniform along the length of the intermediate plenum 68. In contrast, the intermediate plenum 68 varies in the longitudinal direction because the intermediate plenum 68 includes a series of generally cylindrical circulation passages 138, which are discussed in greater detail below.

As best understood with reference to FIG. 3, the upward-oriented and downward-oriented interplenum openings 134, 136 of the intermediate plenum 68 are respectively contiguous with and open to the upward-oriented interplenum opening 108 of the lower plenum 66 and the downward-oriented interplenum opening 88 of the upper plenum 64. As a result, the intermediate plenum cavity 132 is contiguous with and in direct communication with both the upper plenum cavity 86 and the lower plenum cavity 102 so that the plenum cavities 86, 102, 132 together constitute a single large interior space of the composite plenum 18, and in accordance with one particular example that single large interior space has a volume of approximately 10,877 cubic feet.

As best understood with reference to FIG. 2, the circulation passages 138 of the intermediate plenum 68 are arranged in a horizontal row. Each of the circulation passages 138 extends generally laterally and horizontally through the intermediate plenum 68. Only a few of the circulation passages 138 are identified by their reference numeral in FIG. 2. A representative one of the circulation passages 138 will now be described with reference to FIG. 3, which is a partial, cross-sectional view taken substantially along the line 3—3 of FIG. 2. The circulation passage 138 includes an interior wall 140 extending around and defining an interior space 142 of the circulation passage, as well as defining opposite right and left openings 144, 146 to the circulation passage. The interior wall 140 isolates the interior space 142 of the circulation passage 138 from the intermediate cavity 132 defined within the intermediate plenum 68. That is, the interior space 142 of the circulation passage 138 is discontiguous with the intermediate cavity 132. Therefore, the circulation passage 138 does not function as an outlet from the intermediate cavity 132. In contrast, the interior space 142 of the circulation passage 138 is in direct communication with/open to the upper portion of the chamber interior space 54 (FIG. 1) by way of the right and left openings 144, 146 of the circulation passage. The medial portion of the interior wall 140 that is between and distant from the right and left openings 144, 146 to the circulation passage 138 is cylindrical, and at the opposite ends of that cylindrical portion the interior wall tapers by forming larger and larger circles that are coaxial with the cylindrical portion. In addition to the foregoing, the interior wall 140 can be characterized as a fan shroud.

As illustrated in FIGS. 1–3, multiple right and left outlets, which are preferably in the form of right and left nozzles 148, 150 but are not required to be nozzle-like, are respectively mounted to the right and left walls 128, 130 of the intermediate plenum 68. Only a few of the nozzles 148, 150 are specifically identified with their reference numerals in FIG. 1, and only a few of the left nozzles 150 are specifically identified with their reference numeral in FIG. 2. All of the right and left nozzles 148, 150 are capable of providing a communication path between the intermediate cavity 132 and the upper portion of the chamber interior space 54 (FIG. 1). The arrangement and operation of the left nozzles 150 on the left wall 130 of the intermediate plenum 68 is representative of the arrangement and operation of the right nozzles 148 on the right wall 128 of the intermediate plenum. As illustrated in FIG. 2, respective upper and lower groups of the left nozzles 150 are arranged partially around the left opening 146 (FIG. 3) of each of the circulation passages 138. Likewise, respective upper and lower groups of right nozzles 148 are arranged partially around the right opening 144 (FIG. 3) of each of the circulation passages 138.

Representative groups of the nozzles 148, 150 will now be described with reference to FIG. 3 and FIG. 4, which is an isolated left elevation view of a section of the intermediate plenum 68 that includes the circulation passage 138 illustrated in FIG. 3. Heated air within the intermediate plenum cavity 132 is capable of flowing into the upper portion of the chamber interior space 54 through the nozzles 148, 150. It is within the scope of the present invention for the nozzles 148, 150 to be neither converging nor diverging. However, in accordance with the illustrated embodiment, each of the nozzles 148, 150 is preferably a converging nozzle, meaning that the interior diameter of the nozzle decreases in the direction of flow therethrough. As a result of the design of the kiln 10, a jet-like flow of heated air is discharged from the nozzles 148, 150 that are open while the kiln is operated. In accordance with one acceptable example, the jet-like flow from each of the nozzles 148, 150 that is open is a flow of heated air with a circular cross section and a velocity of the order of 200 feet per second. During operation of the kiln 10 the jet-like flow is approximately steady and of steady state. Accordingly, each nozzle 148, 150 can be characterized as defining a discharge axis 152 that generally dictates the direction in which the heated air discharged therefrom initially travels.

Figure 4:
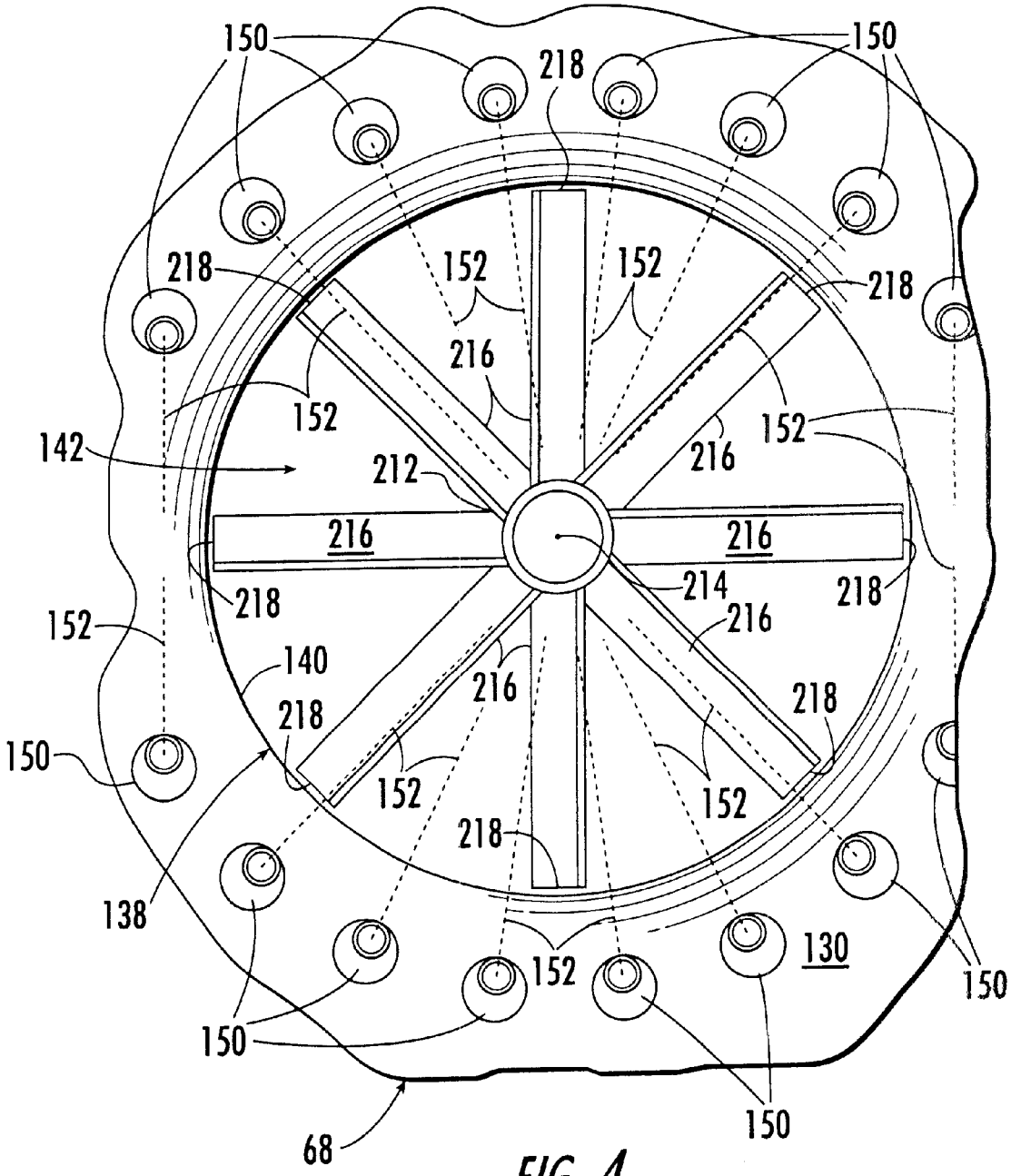
FIG. 4 is a left elevation view of the circulation passage and fan illustrated in FIG. 3, and FIG. 4 also illustrates a portion of the intermediate plenum and some of the nozzle-like outlets carried by the intermediate plenum.

Discharge axes are illustrated by broken lines in FIGS. 3–4.

Different arrangements can be utilized for opening and closing the nozzles 148, 150. For example, one arrangement will be described with reference to FIG. 5.

Another example of an arrangement for opening and closing the nozzles 148, 150 will be subsequently described with reference to FIGS. 6–8, in accordance with an alternative embodiment of the present invention.

Figure 5:
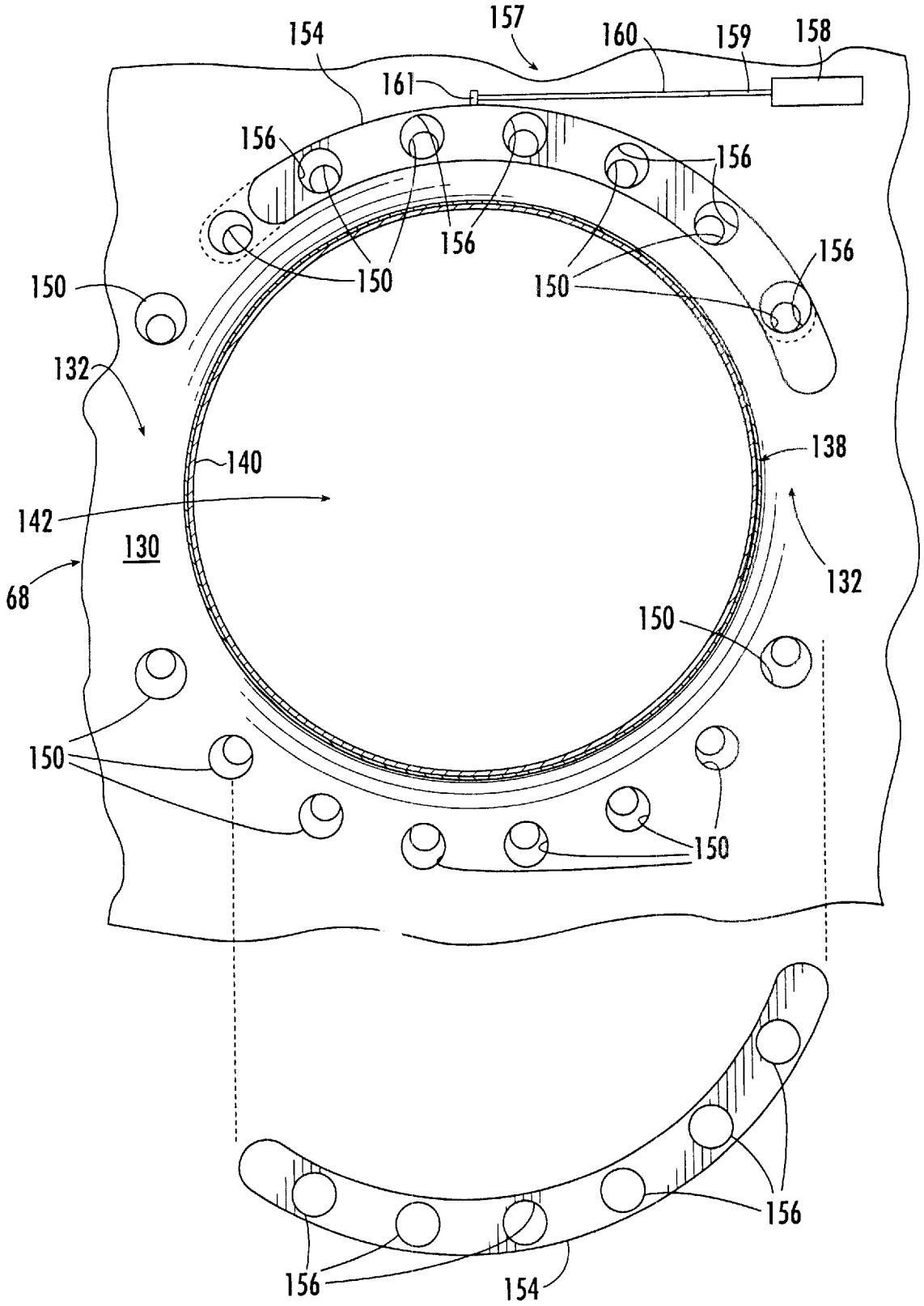
FIG. 5 is a partial and partially exploded schematic view taken along line 5—5 of FIG. 3.

In accordance with one embodiment of the present invention, each of upper groups of right nozzles 148, lower groups of right nozzles, upper groups of left nozzles 150, and lower groups of left nozzles are respectively equipped with nozzle dampers 154 (FIG. 5) positioned in the intermediate plenum cavity 132 and operative for opening and closing the nozzles. Representative upper and lower nozzle dampers 154 will now be described with reference to FIG. 5. The nozzle dampers 154 illustrated in FIG. 5 are carried by the inside surface of the portion of left wall 130 of the intermediate plenum 68 that includes the representative circulation passage 138 and left nozzles 150 illustrated FIG. 4. The nozzle dampers 154 illustrated in FIG. 5 are representative of the other nozzle dampers carried by the inside surface of the left wall 130 of the intermediate plenum 68. Likewise, the nozzle dampers 154 illustrated in FIG. 5 are representative of the nozzle dampers carried by the inside surface of the right wall 128 of the intermediate plenum 68.

The lower nozzle damper 150 illustrated in FIG. 5, which is representative of the upper nozzle damper illustrated in FIG. 5 except for orientation, is exploded away from its respective group of nozzles. Each nozzle damper 150 is arcuate in shape and includes openings 156 spaced along the length thereof, and those openings are sized and spaced in a manner corresponding to the sizing and spacing of the respective nozzles that are opened and closed by the nozzle damper. Brackets or bolting systems (not shown) movably hold the nozzle dampers 154 to the inside surface of the left wall 130 of the intermediate plenum 68.

The operation of the upper nozzle damper 154 illustrated in FIG. 5 and the operation of a damper control system 157 illustrated in FIG. 5 are respectively representative of the operation of the other nozzle dampers and other damper control systems of the kiln 10 (FIG. 1). The upper nozzle damper 154 is illustrated in its open position by solid lines in FIG. 5. In contrast, the upper nozzle damper 154 is illustrated in its closed position by broken lines in FIG. 5. The nozzles 150 associated with the upper nozzle damper 154 are open while the upper nozzle damper is in the open configuration because those nozzles are respectively aligned with and communicating through the openings 156 of the nozzle damper. The nozzles 150 associated with the upper nozzle damper 154 are occluded by solid portions of the upper nozzle damper while the upper nozzle damper is in the closed configuration.

In accordance with the illustrated embodiment of the present invention, movement of the upper nozzle damper 154 between the open and closed configurations is facilitated by the damper control system 157. The damper control system 157 includes a cylinder 158 that is mounted to be stationary and includes a movable push rod 159. The push rod 159 is connected to and moves a control rod 160 that is connected to a clevis 161 that is mounted to the upper nozzle damper 154. As a result, the cylinder 158 can be operated to move the upper nozzle damper 154 between its open and closed configurations. Multiple nozzle dampers 154 can be linked together through the use of additional control rods that are linked together and operated in unison by a single damper control system 157.

The left-most nozzles 150 illustrated in FIG. 5 are not opened and closed by the dampers 154 illustrated in FIG. 5. Rather, there are dampers 154 operative for opening and closing nozzles 150 extending around the circulation passage 138 adjacent to the circulation passage illustrated in FIG. 5. The dampers 154 for that adjacent circulation passage 138 are respectively operative for opening and closing the left-most nozzles 150 illustrated in FIG. 5.

The mounting of the nozzles 148, 150 and the opening and closing thereof will now be described with reference to FIGS. 6–8, in accordance with an alternative embodiment of the present invention that is identical to the embodiment described with reference to FIGS. 1–5, except for variations noted and variations that will be apparent to those of ordinary skill in the art. Only portions of the alternative kiln are illustrated in FIGS. 6–8, and it is to be understood that it is preferred for those representative portions illustrated in FIGS. 6–8 to be duplicated to provide a kiln like that disclosed with respect to FIGS. 1–5, except for the respective substitution of the components illustrated in FIGS. 6–8.

Figure 6:
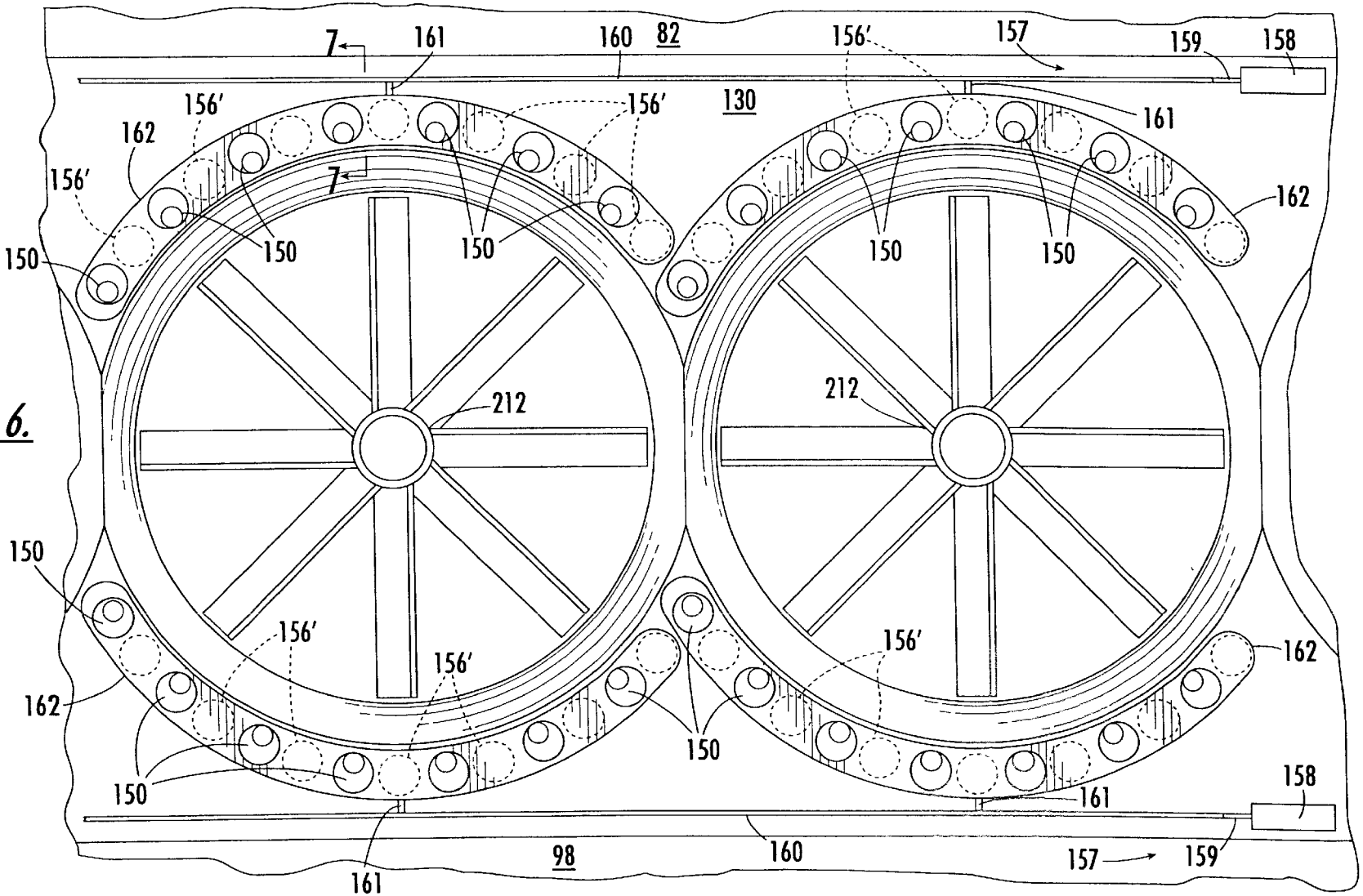
FIG. 6 is a schematic, partial, left elevation view of a portion of the composite plenum and two fans, and FIG. 6 further schematically and representatively illustrates nozzles that are carried by support plates, and holes in dampers that are moved by a damper control system to open and close the nozzles, in accordance with an alternative embodiment of the present invention.
Figure 7:
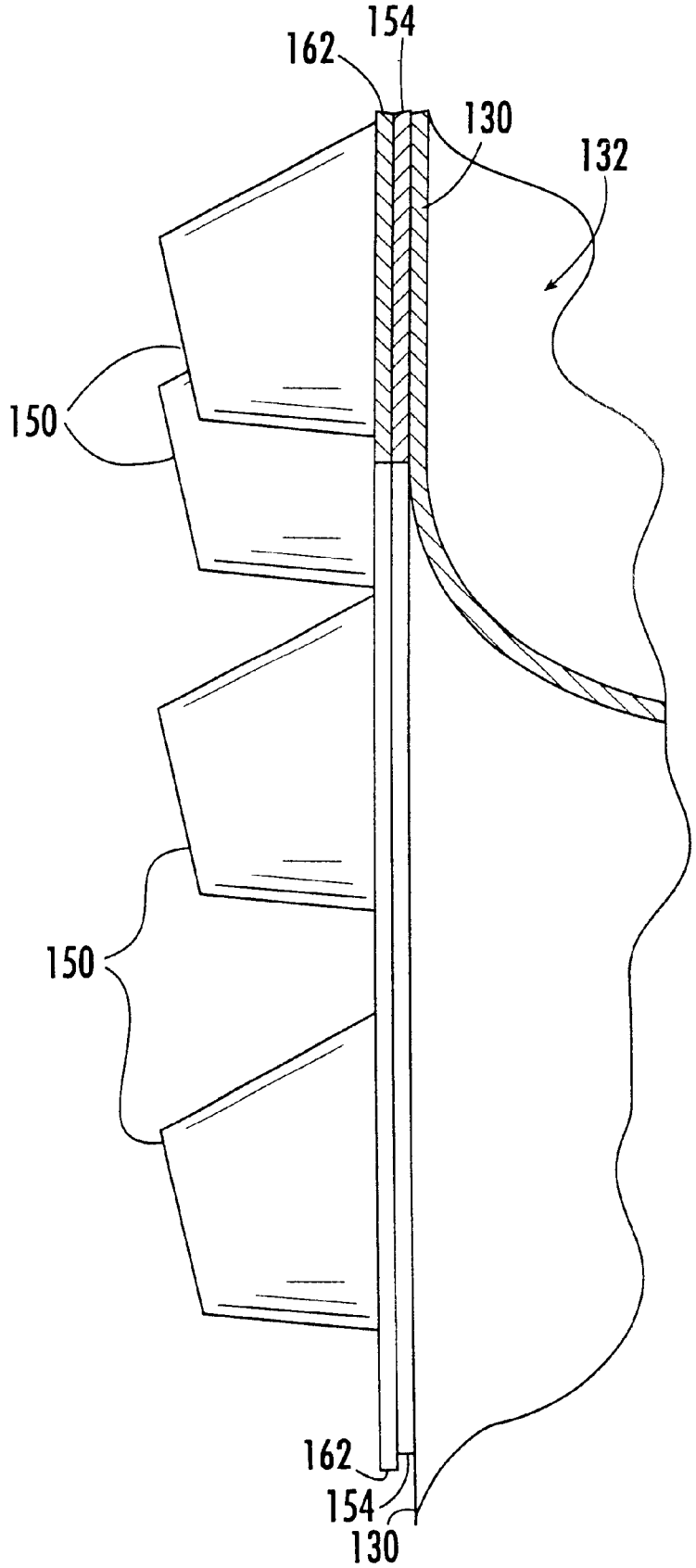
FIG. 7 is a schematic, partial, cross-sectional view taken along line 7—7 of FIG. 6, in accordance with the embodiment illustrated in FIG. 6.
Figure 8:
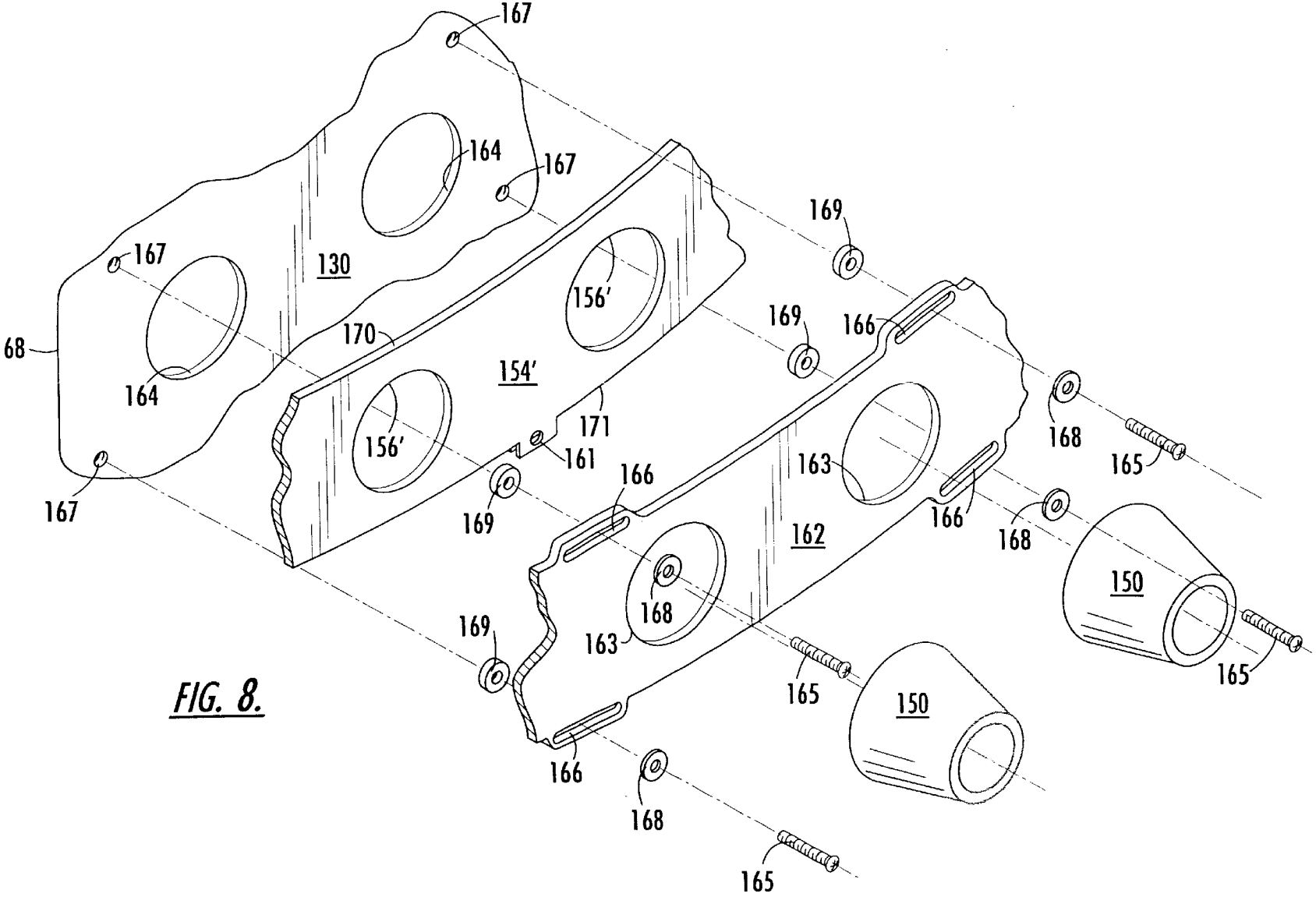
FIG. 8 is a schematic exploded view of representative portions of a left wall of the intermediate plenum of the composite plenum of FIG. 6, a damper, a support plate, and associated attachment means, and a pair of representative nozzles, in accordance with the embodiment illustrated in FIGS. 6–7.

In accordance with the embodiment illustrated in FIGS. 6–8, the mounting of the left nozzles 150 and the arrangement and operation of their associated arcuate nozzle dampers 154' (FIG. 8) and damper control systems 157 (FIG. 6) are representative of the mounting of the right nozzles 148 and the arrangement and operation of the nozzle dampers and damper control systems associated with the right nozzles. In accordance with the embodiment illustrated in FIGS. 6–8, the nozzles 150 are mounted, such as through the use of welding techniques or the like, to outside surfaces of respective arcuate support plates 162. Only a representative few of the nozzles 150 are specifically identified by their reference numeral in FIG. 6. The nozzles 150 are positioned to respectively be coaxial with downstream openings 163 (FIG. 8) that are defined through the support plates 162. The support plates 162 are mounted so that inside surfaces of the support plates are oriented toward the outside surface of the left wall 130 of the intermediate plenum 68. The left wall 130 defines a plurality of upstream openings 164 (FIG. 8) therethrough that are open to the intermediate plenum cavity 134 (FIGS. 3 and 7). The support plates 162 are mounted so that the downstream openings 163 therethrough are capable of being generally coaxial with respective upstream openings 164.

More specifically, and as best understood with reference to the exploded and representative nozzles 150 and portions of the left wall 130, damper 154', support plate 162, and associated components illustrated in FIG. 8, each support plate is mounted to the left wall 130 by multiple bolts 165. Referring to the representative components, or portions thereof, illustrated in FIG. 8, the support plate defines multiple slots 166, and bolts 165 respectively extend through the slots. Each bolt 165 includes a threaded shaft that terminates at a head, and the threaded shafts are threaded into respective threaded bores 167 defined by the left wall 130.

Referring to a representative one of the bolts 165 illustrated in FIG. 8, the shaft of the bolt receives a cylindrical washer 168 prior to the shaft being inserted through its respective slot 166. The shaft of the bolt 165 receives a cylindrical bushing 169 after the shaft has been passed through its washer 168 and slot 166, and prior to the shaft being threaded into its respective threaded bore 167. Each of the washers 168 and bushings 168 has a major diameter that is sufficiently large to prevent the washers and bushings from passing through the respective slots 166 while assembled as described above. Accordingly, the support plate 162 is mounted to the left wall 130 by the bolts 165 and spaced apart from the left wall 130 by the bushings 168. For example, the spacing of a support plate 162 with respect to the wall 130 is illustrated in FIG. 7.

Further referring to the representative components, or portions thereof, illustrated in FIG. 8, a nozzle damper 154' is positioned in the space between the support plate 162 and the left wall 130. An inner edge 170 of the nozzle damper 154' engages and is selectively movable relative to inner ones of the bushing 169 (that is, the upper bushings illustrated in FIG. 8). Likewise an outer edge 171 of the nozzle damper 154' engages and is selectively moveable relative to outer ones of the bushings 169 (that is, the lower bushings illustrated in FIG. 8). The nozzle damper 154' defines multiple intermediate openings 156' therethrough and the nozzle damper is moveable between open and closed configurations. In the open configuration, the intermediate openings 156' are generally respectively aligned with upstream openings 164, downstream openings 163, and nozzles 150, as is generally illustrated in FIG. 8, so that heated air is supplied through the nozzles. In contrast and as illustrated in FIG. 6, in the closed configuration the intermediate openings 156', which are illustrated by broken lines in FIG. 6, are offset from upstream openings 164, downstream openings 163, and nozzles 150 so that heated air is not supplied through the nozzles. Only a representative few of the intermediate openings 156' are specifically identified by their reference numeral in FIG. 6.

In accordance with the embodiment illustrated in FIGS. 6–8, movement of the nozzle dampers 154' between the open and closed configurations is facilitated by the damper control systems 157 (FIG. 6). As best understood with reference to FIG. 6, each damper control system 157 includes a cylinder 158 that is mounted to be stationary and includes a movable push rod 159. The push rod 159 is connected to and moves one or more control rods 160 that are respectively connected to devises 161 that are respectively mounted to the dampers 154'. As a result, the cylinder 158 can be operated to move multiple nozzle damper 154' between their open and closed configurations.

Further referring to the representative components, or portions thereof, illustrated in FIG. 8, the amount of flow through the nozzles 150 while the damper 154' is in its open configuration can be adjusted by adjusting the alignment of the nozzles with the with upstream and intermediate openings 164, 156'. The alignment can be adjusted by loosening the bolts 165 so that the support plate 162 is movable relative to the wall 130. Thereafter, the support plate 162, which remains supported by the bolts 165, is manually moved the desired amount so that the bolts are positioned differently in their respective slots 166. Thereafter, the bolts 165 are tightened to secure the support plate 162 in its new position. This procedure can be used to increase or decrease the alignment between the nozzles 150 with their respective upstream and intermediate openings 164, 156' so that the flow through the nozzles is respectively increased or decreased.

As best understood with reference to FIG. 1, in accordance with another alternative embodiment that is not illustrated, the nozzles 148, 150 are connected to the upper and lower plenums 64, 66 rather than being connected to the intermediate plenum 68. More specifically, the upper right nozzles 148 are mounted to the lower right wall 76 of the upper plenum 64 and are capable of providing a communication path between the upper plenum cavity 86 (FIG. 3) and the upper portion of the chamber interior space 54. Similarly, the upper left nozzles 150 are mounted to the lower left wall 82 of the upper plenum 64 and are capable of providing a communication path between the upper plenum cavity 86 and the upper portion of the chamber interior space 54. Further, the lower right nozzles 148 are mounted to the right wall 94 of the lower plenum 66 and are capable of providing a communication path between the lower plenum cavity 102 (FIG. 3) and the lower portion of the chamber interior space 30. Similarly, the lower left nozzles 150 are mounted to the left wall 98 of the lower plenum 66 and are capable of providing a communication path between the lower plenum cavity 102 and the lower portion of the chamber interior space 30. In accordance with this alternative embodiment, the components for opening and closing the nozzles 148, 150 are relocated accordingly.

The suspension furnace 16 of the illustrated embodiment of the present invention is diagrammatically illustrated in FIG. 1. The furnace 16 includes a mixing chamber 174 in which combustible fuel is burned to create fire 176. Preferably some ambient air is provided into the furnace 16 to facilitate its operation, and roof vents (not shown) are included in the kiln chamber 12 to facilitate a corresponding release of air to the ambinet environment. The fire 176 creates combustion by-products that are mixed with heated air. The furnace 16 includes an air moving device 178 that moves the heated air and associated combustion by-products. Accordingly, for the portions of the Detailed Description of the Invention section of this disclosure that describe the embodiment of the present invention that is illustrated in FIGS. 1–6, "heated air" refers to the combination of the air heated by the furnace 16 and the combustion by-products carried by that heated air. In accordance with another embodiment of the present invention, the furnace 16 includes a heat exchanger and is operated so that the air heated by the furnace is substantially absent of the combustion by-products created by the fire 176. Further, it is within the scope of the present invention for the furnace 16 to be of any type that is conventionally used to provide heated air to a plenum that distributes the heated air.

The duct system 19 that extends from the furnace 16 is schematically illustrated in FIG. 1 as including a hot duct assembly 180 and a cool duct assembly 182. The hot duct assembly 180 directs heated air from the furnace 16 to the composite plenum 18.

The hot duct assembly 180 includes an upstream duct 184 having an upstream end connected to and in direct communication with the furnace 16, and a bifurcated downstream end connected to and in communication with both an upper downstream duct 186 and a lower downstream duct 188. An adjustable damper 190 is positioned within the upstream duct 184 at the juncture with the downstream ducts 186, 188 for balancing or adjusting the flows into the downstream ducts. The upper downstream duct includes an outlet end 192 (also see FIG. 2) that is mounted to the upper plenum 64 and is in direct communication with the upper plenum cavity 86. The lower downstream duct 188 includes an outlet end 194 (also see FIG. 2) that is mounted to the lower plenum 66 and is in direct communication with the lower plenum cavity 102.

The cool duct assembly 182 directs air from the upper portion of the chamber interior space 54 to the furnace 16. The cool duct 182 assembly includes a pair of right return ducts 196 (also see FIG. 2) and a pair of left return ducts 198 (only one of which is shown) having upstream ends mounted to the roof 60 and capable of being in direct communication with the upper portion of the chamber interior space 54.

Different arrangements can be utilized for opening and closing the return ducts 196, 198. For example, one arrangement will be described with reference to FIG. 1. Another example of an arrangement for opening and closing the return ducts 196', 198' will be described with reference to FIG. 9, in accordance with an alternative embodiment of the present invention.

In accordance with the embodiment illustrated in FIG. 1, each of the right return ducts 196 is equipped with a respective right return damper 200 (only one of which is shown) that is capable of being moved to open and close the duct. Likewise, each of the left return ducts 198 is equipped with a respective left return damper 202 (only one of which is shown) that is capable of being moved to open and close the duct. The right return damper 200 illustrated in FIG. 1 is positioned so that the right return duct 196 illustrated in FIG. 1 is open to the upper portion of the chamber interior space 54. In contrast, the left return damper 202 illustrated in FIG. 1 is positioned so that the left return duct 198 illustrated in FIG. 1 is isolated from the upper portion of the chamber interior space 54.

The opening and closing of return ducts 196', 198' will now be described with reference to FIG. 9, in accordance with an alternative embodiment of the present invention that is identical to the embodiment described with reference to FIGS. 1–5, except for variations noted and variations that will be apparent to those of ordinary skill in the art. In accordance with this alternative embodiment, one of the right return ducts 196' joins one of the left return ducts 198' and a downstream duct 193 to form a tee. There are preferably two separate tees (that is, two separate right return ducts 196', two separate left return ducts 198', and two downstream ducts 193) and associated components. Whereas only a single tee is illustrated in FIG. 9, the illustrated tee and its associated components are representative of the corresponding yet not illustrated tee and its associated components.

Figure 9:
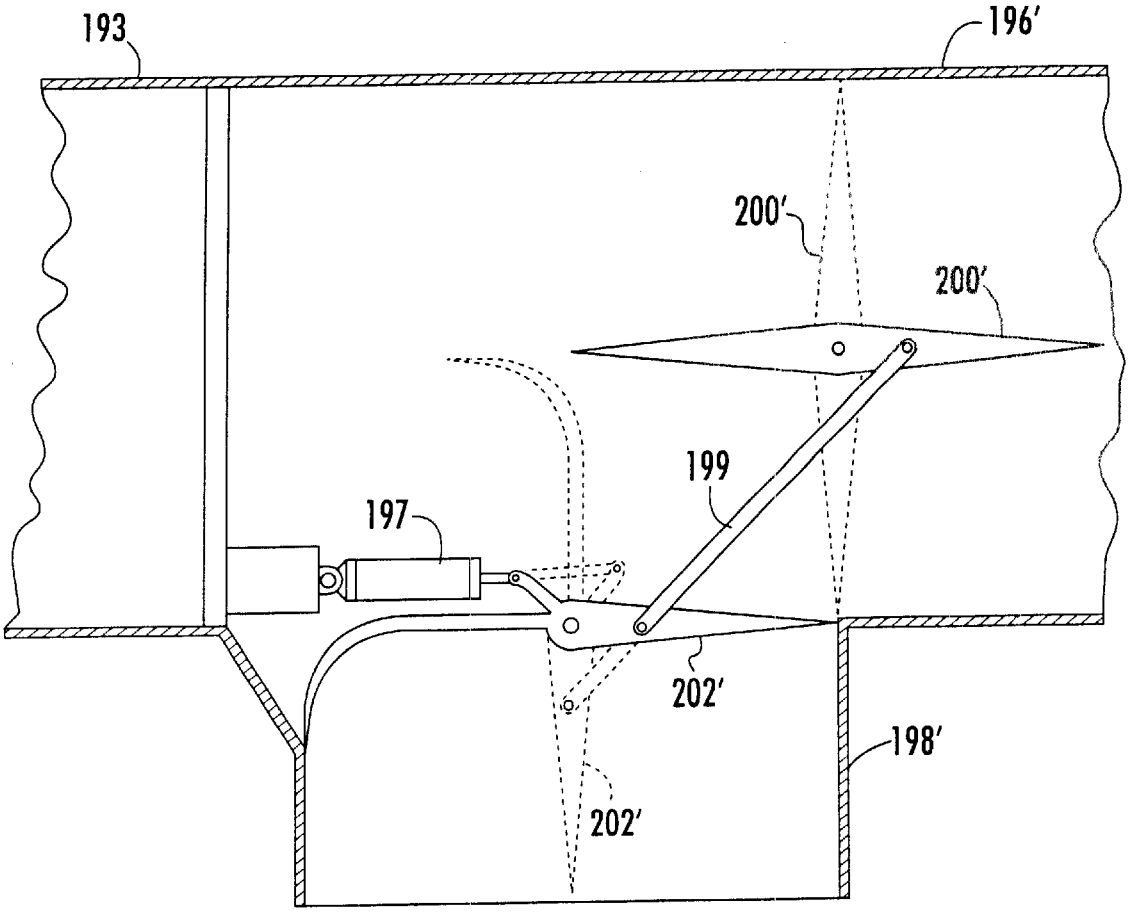
FIG. 9 is a schematic, partial, and side sectional view of a representative tee formed by return ducts, and FIG. 9 schematically illustrates a damper system within the tee in both open and closed configurations, in accordance with an alternative embodiment of the present invention.

Referring to the representative components illustrated in FIG. 9, the downstream duct 193 provides the communication path from the right and left return ducts 196', 198' to the mixing chamber 174 (FIG. 1). As illustrated in FIG. 9, the right return damper 200' is positioned in the right return duct 196' at the tee. Similarly, the left return damper 202' is positioned in the left return duct 198' at the tee. Each of the dampers 200', 202' are respectively centrally pivotally mounted and moveable between the positions indicated by solid and broken lines in FIG. 9. In addition, a linkage 199 is connected between and links the dampers 200', 202', and a piston assembly 197 is mounted within the tee and connected to the left return damper 202'. The piston assembly 197 is operated and the linkage 199 is operative so that the dampers 200', 202' move together between the positions illustrated by solid lines and the positions illustrated by broken lines in FIG. 9. Accordingly, the right return duct 196' is in communication with and the left return duct 198' is not in communication with the mixing chamber 174 via the downstream duct 193 while the dampers 200', 202' are in the positions illustrated by solid lines in FIG. 9. In contrast, the right return duct 196' is not in communication with and the left return duct 198' is in communication with the mixing chamber 174 via the downstream duct 193 while the dampers 200', 202' are in the positions illustrated by broken lines in FIG. 9.

As best understood with reference to FIG. 2, air moving devices, which are fans 20 in accordance with the illustrated embodiment of the present invention, are positioned within the upper portion of the chamber interior space 54 in a parallel arrangement that extends in the longitudinal direction. The fans 20 are capable of providing a recirculating flow path 204 within the upper and lower portions of the chamber interior space 54, 30. The general center of the recirculating flow path 204 is schematically illustrated in FIG. 1 by a line made up of a series of two short dashes alternating with one dash. The fans 20 are reversible and can be operated so that all of the air within the upper and lower portions of the chamber interior space 54, 30 moves either in a clockwise direction along the recirculating flow path 204 or a counterclockwise direction along the recirculating flow path. Throughout the Detailed Description of the Invention section of this disclosure, FIG. 1 is the frame of reference with respect to which flow in the clockwise and counterclockwise directions is defined. The direction of operation of the fans 20 is periodically reversed during the drying of a charge 14 of lumber because reversing the flow helps to uniformly dry the charge of lumber.

As shown in FIG. 2, each of the circulation passages 138 is equipped with a respective fan 20. Only a few of the fans 20 are identified by their reference numeral in FIG. 2. A representative one of the fans 20 will now be described with reference to FIG. 1, in which a portion of the representative fan is hidden from view and therefore shown in broken lines. The fan 20 includes a motor 206 that rotates a drive shaft 208 by way of a drive belt 210. An impeller 212 is mounted to the end of the drive shaft 208 and is positioned within the respective circulation passage 138. Portions of a representative one of the fans 20 will now be described with reference to FIG. 3. The motor 206 and drive belt 210 are not shown and the drive shaft 208 is partially cut away in FIG. 3. Whereas FIG. 3 is a cross-sectional view taken substantially along line 3—3 of FIG. 2, the impeller 212 and drive shaft 208 are not cross-sectioned in FIG. 3. The fan 20, or more specifically the impeller 212, has a rotational axis 214 that dictates the general direction in which the air moved by the fan initially travels. The interior wall 140 of the respective circulation passage 138 extends around and is coaxial with the rotational axis 214. The impeller 212 includes multiple blades 216 that extend radially away from proximate the rotational axis 214 of the impeller, and each blade includes a blade tip 218 that is distant from the rotational axis. As best understood with reference to FIG. 2, the rotational axes (for example see the rotational axis 214 illustrated in FIG. 3) of all of the impellers 212 are parallel and extend in a common horizontal plane.

Construction of the Kiln

Some of the aspects relating to the efficient construction of the kiln 10 will now be described, in accordance with one embodiment of the present invention. The kiln 10 is preferably at least partially constructed and assembled using modular construction techniques. More specifically, the composite plenum 18 and other components of the kiln 10 are at least partially pre-manufactured remotely from the final construction site of the kiln and are trucked to the final construction site of the kiln.

In accordance with one embodiment of the present invention, the composite plenum 18 is in multiple different and separate pieces when shipped to the final construction site, and those pieces are welded or bolted together, or the like, at the construction site such that in isolation the assembled composite plenum is absent of movable parts. In contrast, in accordance with another embodiment of the present invention, the composite plenum 18 is constructed so that it can originally be transitioned between extended and collapsed configurations by moving (that is, telescoping) the intermediate plenum 68 into and out of the upward-oriented interplenum opening 108 (FIG. 3) of the lower plenum 66. The extended configuration is illustrated by solid lines in FIGS. 1–3 and by the broken line in FIG. 10 that is in the form of alternating short and long dashes. In contrast, the collapsed configuration is illustrated by solid lines and by the broken line that is in the form of uniform dashes in FIG. 10. As illustrated, the upper plenum 64 is mounted to the intermediate plenum 68 during both the compacted and extended configurations. Portions of the protrusions 96, 100 of the lower plenum 66 are cut away in FIG. 10.

Figure 10:
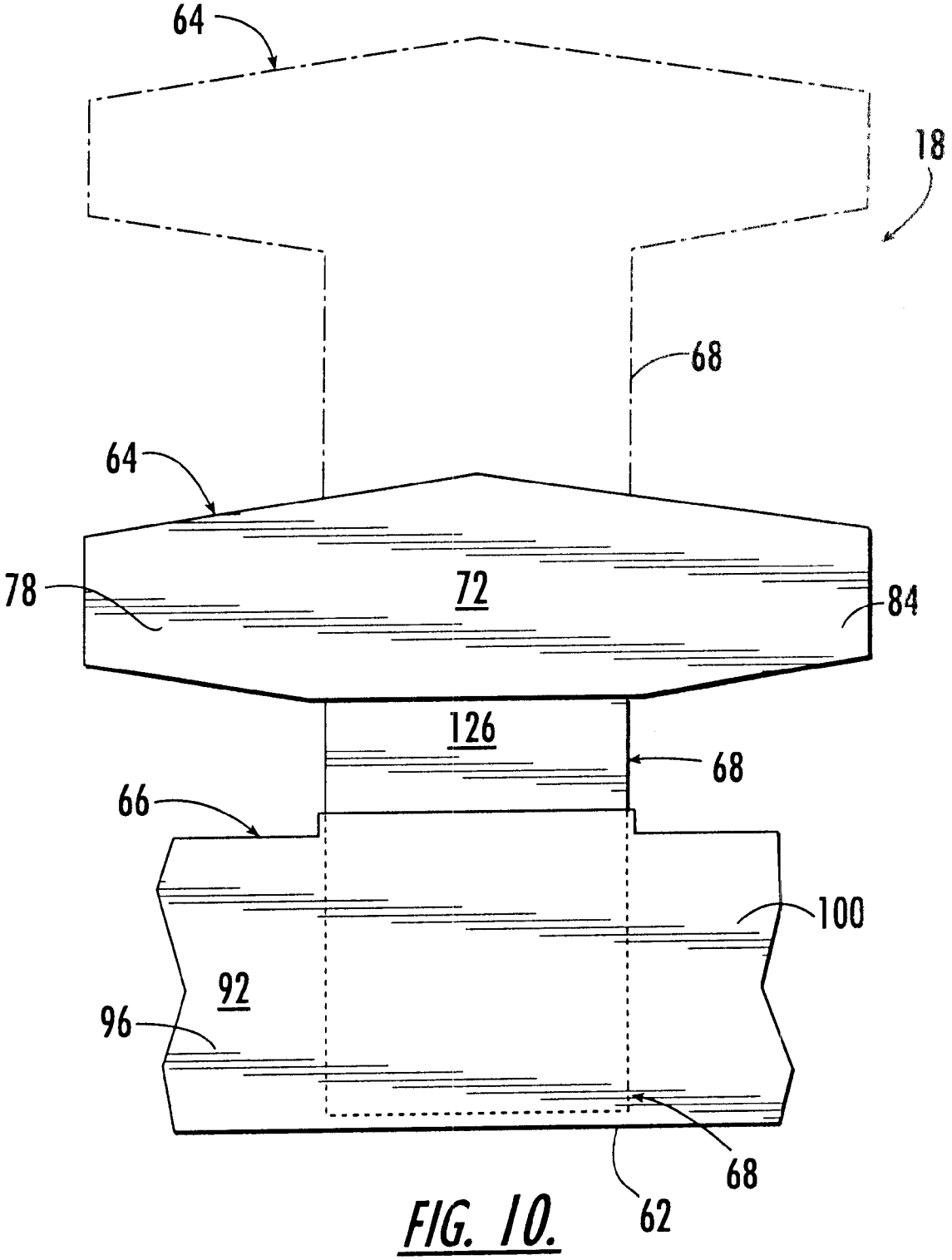
FIG. 10 is an isolated, schematic, rear end elevation view illustrating a telescopic composite plenum that can be used in the kiln of FIG. 1, in accordance with one embodiment of the present invention, wherein the composite plenum is illustrated in both compacted and extended configurations.

Further regarding the telescoping composite plenum 18 and as best understood with reference to FIG. 10, the walls 124, 126, 128, 130 (also see FIGS. 1–5) of the intermediate plenum 68 extend through the upward-oriented interplenum opening 108 (FIG. 3) of the lower plenum 66 and the lower ends of the walls of the intermediate plenum extend into the lower plenum cavity 102 and are proximate the lower wall 62 during the compacted configuration. As a result, the walls 90, 92, 94, 98 (also see FIG. 1–3) of the lower plenum 66 that extend around and define the upward-oriented interplenum opening 108 of the lower plenum 66 overlap the walls 124, 126, 128, 130 of the intermediate plenum 68, so that those walls of the intermediate plenum can be characterized as underlapping walls. At least lower ones of the nozzles 148, 150 (FIGS. 2–5) are not mounted to the intermediate plenum 68 during the compacted configuration, because at least some of the nozzles would interfere with the telescoping.

The telescoping capability is particularly advantageous when the kiln 10 is constructed and assembled using modular construction techniques. The composite plenum 18 is assembled and placed in the collapsed configuration at a location remote from the final site of the kiln 10 and is thereafter transported to the final site of the kiln, where the composite plenum is placed in the extended configuration. The extended configuration is achieved by telescopically lifting the combination of the upper and intermediate plenums 64, 68 with respect to the lower plenum 66, such as through the use of a crane, or the like. The combination of the upper and intermediate plenums 64, 68 is lifted so that at least substantially less of the intermediate plenum extends into the lower cavity 102 of the lower plenum 66 during the extended configuration than during the compacted configuration. Lower portions of the intermediate plenum 68 are then immovably mounted to the lower plenum 66 to hold the composite plenum 18 in the extended configuration through the use of conventional mounting techniques, such as welding, bolting, or the like. Thereafter, the nozzles 148, 150 are mounted to the intermediate plenum 68 through the use of conventional mounting techniques, such as welding, bolting, or the like.

The slab 32 is poured at the final location of the kiln 10. The load-bearing front and rear walls 34, 36 are positioned generally vertically upon the slab 32 and are spaced apart from one another in the longitudinal direction. Other walls of the kiln chamber 12 may be placed upon the slab 32 along with the load-bearing front and rear walls 34, 36 to stabilize the load-bearing front and rear walls. Thereafter, the composite plenum 18 is lifted, such as through the use of a crane, and the composite plenum is lowered so that the front and rear ends of the bottom wall 62 respectively rest upon the load-bearing front and rear walls 34, 36, as is illustrated in FIG. 2. The composite plenum 18 is secured to the load-bearing front and rear walls 34, 36 through the use of conventional construction techniques, such as welding, or bolting, or the like. Thereafter, the other walls 56, 58 and the roof 60 of the kiln chamber 12 are installed in a generally modular fashion to define the upper and lower portions of the chamber interior space 54, 30. In accordance with the illustrated embodiment the kiln chamber 12 is constructed so that the composite plenum 18 is suspended above the slab 32 solely by the load-bearing front and rear walls 34, 36. In addition, the roof 60 and at least some of the upper front and rear walls 56, 58 of the kiln chamber are mounted directly to and carried by the composite plenum 18. As such, the composite plenum 18 and the load bearing portions of the front and rear walls 34, 36 are preferably formed of steel in order to support the kiln components carried thereby without additional load bearing structures.

In accordance with another embodiment of the present invention, the kiln 10 is more completely built at the final construction site of the kiln using construction techniques other than modular construction techniques.

Operation of the Kiln

The kiln 10 operates in a manner that efficiently dries a charge 14 of lumber. The basic operation of the kiln 10 will now be described, in accordance with one embodiment of the present invention, with occasional reference to exemplary advantageous aspects of the kiln. Advantageous aspects of the kiln 10 include, but are not limited to, those that promote the uniform drying of the charge 14 of lumber, that reduce flow-related losses within the kiln, that optimize heat utilization within the kiln, that enhance the operation of the fans 20, that enhance the mixing of the heated air within the upper portion of the chamber interior space 54, and that enhance balanced flow through the charge of lumber. Although some of the aspects of the kiln 10 are described in the context of a single advantage, those of ordinary skill in the art will appreciate that at least some of the recited advantages are not independent of one another. Further, this disclosure is not intended to provide an exhaustive list of all of the advantages provided by the present invention.

The kiln 10 is readied for operation by using the transportation system, which includes the tracks 50 and wheeled carriages 52, to placing a charge 14 of green lumber within the charge-receiving space by way of the front door opening 38. Thereafter, the front and rear doors 40, 44 are closed to respectively close the front and rear door openings 38, 42. In addition, other openings (not shown) of the kiln chamber 12 are closed so that the interior space of the kiln chamber is generally enclosed. Some leakage of air into and out of the interior space of the kiln chamber 12 is desired, however, so that moisture escapes from the interior space of the kiln chamber and ambient air is drawn into the interior space of the kiln chamber. Such leakage can be controlled through the use of roof vents (not shown).

After the interior space of the kiln chamber 12 is generally sealed with a charge 14 of green lumber in the charge-receiving space, the furnace 16 is operated to supply heated air to the interior space of the kiln chamber 12 and the fans 20 are operated to move the heated air along the recirculating flow path 204. In accordance with one aspect of the kiln 10, the direction of operation of the fans is periodically reversed while a charge 14 of lumber is being dried, which promotes the uniform drying of the charge of lumber. Each fan 20 is operated in a manner that promotes clockwise flow along the recirculating flow path 204 during a clockwise mode. For each fan 20, the right side thereof is the high-pressure or discharge side and the left side thereof is the low-pressure or intake side during the clockwise mode. Likewise, each fan 20 is operated in a manner that promotes counterclockwise flow along the recirculating flow path 204 during a counterclockwise mode. For each fan 20 the left side thereof is the high-pressure or discharge side and the right side thereof is the low-pressure or intake side during the counterclockwise mode.

The fans 20 temporarily come to a complete stop when the transition is made from clockwise to counterclockwise flow. The air temperature in the kiln chamber 12 increases while the fans 20 are not operating. When the fans 20 restart, air within the kiln chamber 12 cools and contracts due to being circulated through the charge 14 of lumber. Leakage paths are provided, such as via roof vents (not shown), to allow ambient air to flow into the kiln chamber 12 to compensate for the contraction.

The furnace 16 is operated so that the air moving device 178 of the furnace moves heated air from the mixing chamber 174 to the composite plenum 18 by way of the hot duct assembly 180. In accordance with another aspect of the kiln 10, the composite plenum 18 is sized and the kiln 10 is designed and operated so that the heated air within the interior space of the composite plenum is at a relatively high pressure and has a relatively low velocity, which reduces flow-related losses within the composite plenum and facilitates the balancing of flow from the composite plenum to the interior space of the kiln chamber 12. More specifically, in accordance with one exemplary embodiment the interior space of the composite plenum 18 has a volume that is at least approximately as large as the total volume of the lumber load (i.e., the volume of the charge of lumber 14), and more specifically the volume of the composite plenum is approximately equal to the total volume of the lumber load, and most specifically the interior space of the composite plenum has a volume of approximately 10,877 cubic feet and the total volume of the lumber load (that is, the sum of the volume of the right and left stack receiving spaces) is approximately 10,682.5 cubic feet.

In accordance with another aspect of the kiln 10, the right radius of curvature 104 defined by the right wall 94 of the lower plenum 66 provides for a smooth transition of the flow along the recirculation flow path 204 from the upper portion of the chamber interior space 54 to the lower portion of the chamber interior space 30 during the clockwise mode, which reduces flow-related losses within the kiln. In addition, the right radius of curvature provides for a smooth transition of the flow along the recirculation flow path 204 from the lower portion of the chamber interior space 30 to the upper portion of the chamber interior space 54 during the counterclockwise mode. Likewise, the left radius of curvature 106 defined by the left wall 98 of the lower plenum 66 provides for a smooth transition of the flow along the recirculation flow path 204 from the upper portion of the chamber interior space 54 to the lower portion of the chamber interior space 30 during the counterclockwise mode. In addition, the left radius of curvature 106 provides for a smooth transition of the flow from the lower portion of the chamber interior space 30 to the upper portion of the chamber interior space 54 during the clockwise mode.

In accordance with another aspect of the kiln 10, the cool duct assembly 182 is operated so the air moving device 178 of the furnace 16 draws only relatively cool air from the interior space of the kiln chamber 12 to the mixing chamber 174, which optimizes heat utilization within the kiln. More specifically, the return dampers 200, 202 are operated so that the left return ducts 198 are open and the right return ducts 196 are closed, or the return dampers 200', 202' are operated so that the left return ducts 198' are open and the right return ducts 196' are closed, during the clockwise mode. As a result, the air moving device 178 draws air into the mixing chamber 174 of the furnace 16 from the left portion of the upper portion of the chamber interior space 54 during the clockwise mode. In contrast, the return dampers 200, 202 are operated so that the right return ducts 196 are open and the left return ducts 198 are closed, or the return dampers 200', 202' are operated so that the right return ducts 196' are open and the left return ducts 198' are closed, during the counterclockwise mode. As a result, the air moving device 178 draws air into the mixing chamber 174 from the right portion of the upper portion of the chamber interior space 54 during the counterclockwise mode.

In accordance with another aspect of the kiln 10, operation of the fans 20 is optimized by operating the control systems 150 that move the nozzle dampers 154, or by operating the control systems 150 that move the nozzle dampers 154', so that heated air is provided to the upper portion of the chamber interior space 54 substantially solely by either the right nozzles 148 or the left nozzles 150. More specifically, the nozzle dampers 154 or the nozzle dampers 154' carried by the left wall 130 of the intermediate plenum 68 are in their closed configurations and the nozzle dampers 154 or the nozzle dampers 154' carried by the right wall 128 of the intermediate plenum are in their open configurations while the fans 20 operate in the clockwise mode. As a result, any amount of heated air supplied from the composite plenum 18 to the upper portion of the chamber interior space 54 through the left nozzles 150 is substantially less than the amount of heated air supplied to the upper portion of the chamber interior space through the right nozzles 148 during the clockwise mode. In contrast, the nozzle dampers 154 or the nozzle dampers 154' carried by the right wall 128 of the intermediate plenum 68 are in their closed configurations and the nozzle dampers 154 or the nozzle dampers 154' carried by the left wall 130 of the intermediate plenum are in their open configurations while the fans 20 operate in the counterclockwise mode. As a result, any amount of heated air supplied from the composite plenum 18 to the upper portion of the chamber interior space 54 through the right nozzles 148 is substantially less than the amount of heat supplied to the upper portion of the chamber interior space through the left nozzles 152 during the counterclockwise mode.

In accordance with another aspect of the kiln 10, operation of the kiln 10 and, more particularly, operation of the fans 20 is optimized by the jet-like flow of heated air that is discharged by the nozzles 148, 150. Due to the strategic opening and closing of the nozzle dampers 154 as described above, the jet-like flow always originates proximate the discharge side of the fans 20, and the nozzles 148, 150 are oriented so that all of the discharge axes 152 of the nozzles are directed at least generally parallel to the rotational axes 214 of the fans 20. Because the heated gas introduced into the upper portion of the chamber interior space 54 flows at least generally parallel to the rotational axes of the fans 20 and at least generally in the same direction as the flow being discharged by the fans 20, the momentum of the flow along the recirculating flow path 204 is not sacrificed in order to accelerate the hot gas, which is supplied through the nozzles 148, 150, in the desired direction. More specifically, in accordance with one embodiment of the present invention, the hot gas introduced through the nozzles augments the flow from the fans 20 and serves to increase the velocity along the recirculating flow path 204 so that the velocity along the recirculating flow path is greater while the fans are operating and hot air is introduced through the nozzles than when the fans are operating and hot air is not supplied through the nozzles. Stated differently, the jet-like flow from the nozzles 148, 150 that are open has momentum that is mostly parallel to the rotational axes 214, and all of that momentum is in the downstream direction, which is the direction of flow defined by the exit velocity of the fans 20. The jet-like flow from the nozzles 148, 150 that are open has a velocity greater than the component of the exit flow from the fans 20 that extends in the direction of the rotational axes 214. As a result, any momentum exchange is such that the exit flow from the fans 20 experiences an increase in momentum in the downstream direction. More specifically, in accordance with one embodiment, the jet-like flow of heated air discharged from each of the nozzles 148, 150 that is open has a velocity at least as great as the velocity of the flow discharged from each of the fans 20, and more preferably the jet-like flow of heated air discharged from each of the nozzles that is open has a velocity of the order of 200 feet per second, whereas the flow discharged from each of the fans has a velocity of the order of 25 feet per second.

In addition, the nozzles 148, 150 are preferably arranged generally around the fans 20 and/or are in close proximity to the fans 20. This arrangement reduces the pressure near the exits of the fans 20 by means of Bernoulli's principle, thus further assisting the operation of the fans. More specifically, the static pressure near the jet-like flow is low because the velocity of the jet-like flow is high. That low pressure is proximate the exits of the fans 20 and provides a venturi effect at the exits of the fans. That venturi effect provides a slight suction to the exits of the fans 20 which enhances the operation of the fans 20.

In accordance with another aspect of the kiln 10, operation of the fans 20 is optimized because the blade tips 218 of the impellers 212 extend at least to, and preferably into, respective flow-induced boundary layers 220 (FIG. 3). This aspect of the kiln 10 will now be described with respect to the design and operation of the representative fan 20 and circulation passage 138 illustrated in FIG. 3, in accordance with one embodiment of the present invention. When the fan 20 is operated in the counterclockwise mode, the impeller 212 rotates about the rotational axis 214 and forces flow through the circulation passage 138, resulting in the formation of a flow-induced boundary layer 220. The flow-induced boundary layer 220 is schematically illustrated by dashed lines that are within the circulation passage 138 and adjacent the surface of the interior wall 140 that faces the impeller 212. The flow-induced boundary layer related aspects associated with the operation the fan 20 in the counterclockwise mode are identical to the flow-induced boundary layer aspects associated with the operation of the fan in the clockwise mode, except that the impeller rotates in the opposite direction and the flow-induced boundary layer originates proximate the left opening 146 to the circulation passage 138 rather than the right opening 144.

The fan 20 and the circulation passage 138 are constructed so that the blade tips 218 extend at least to, and preferably into, the flow-induced boundary layer 220 while the fan is operated, which restricts bypass flow proximate to the blade tips. The flow-induced boundary layer 220 extends generally uniformly for 360 degrees around the rotational axis 214 of the impeller 212, and each of the blade tips 218 remain within the flow-induced boundary layer as they rotate 360 degrees around the rotational axis. The internal diameter and length of the circulation passage 138 and the design and rotational speed of the impeller 212 are selected so that the blade tips 218 extend at least to, and preferably into, the flow-induced boundary layer 220 while the fan 20 is operated. For example, the impeller 212 is designed so that the blade tips 218 are proximate the interior wall 140 and the interior wall is sufficiently lengthy in the lateral direction so that the boundary layer 220 is sufficiently thick to contact the blade tips. More specifically, the right and left walls 128, 130 of the intermediate plenum 68 respectively define a right and left inlet plane. Inlet distances "d9" are respectively defined between the right and left inlet planes and the right-most and left-most leading edges of the blades 216. In addition, the impeller 212 defines a diameter "d10", and in the vicinity of the impeller the surface of the interior wall 140 upon which the boundary layer 220 forms defines an internal diameter "d1 ".

The impeller 212 and the circulation passage are preferably coaxial, and the internal diameter "d1 " of the circulation passage 138 is preferably approximately 0.5 inches greater than the diameter "d10" of the impeller 212. Further, the inlet distance "d9" divided by the impeller diameter "d10" is preferably at least approximately 0.167, is more preferably in the range of approximately 0.167 to approximately 0.317, and is even more preferably approximately 0.317, and most preferably the inlet distance "d9" is approximately 2 feet and the impeller diameter is approximately 6 feet. In addition to playing a role in facilitating the preferred formation of the boundary layer 220, it is believed that the inlet distance "d9" of approximately 2 feet will allow the flow entering the impeller 212 to align itself with the impeller and begin a small amount of pre-swirl before entering the impeller.

The velocity into the impeller 212 depends upon the design of the blades 216, the pitch of the blades, and the rotational speed of the impeller. It is preferred for the blade tips 218 to have a velocity of approximately 298.5 ft/sec. The flow entering the impeller 212 travels along a spiral path because of the influence of the rotation of the impeller. The distance of the spiral path proximate the surface of the interior wall 140 upon which the boundary layer 200 forms may be estimated based upon the vector sum of the rotational and axial components of the velocity of the blades 216. The magnitude of the velocity along the spiral path proximate the surface of the interior wall 140 upon which the boundary layer 200 forms is similarly the sum of the axial and circumferential components of the velocity of the blades 216. The circumferential component increases as the flow approaches the leading edges of the blades 216. The velocity also varies radially since the peak work region of each blade 216 occurs at approximately 70% of the blade radius. The velocity of interest is adjacent the surface of the interior wall 140 upon which the boundary layer 220 forms. At this location the velocity will be reduced according to the spanwise distribution along the blade. This distribution peaks near 70% of the tip radius and is zero at the tip. The resultant distance and velocity are calculated using a time step average. For this case, the pertinent length of the spiral travel path proximate the surface of the interior wall 140 upon which the boundary layer 200 forms, which is "L" in the following equation, is approximately 16.2 feet, and the pertinent velocity along that spiral travel path, which is "U" in the following equation, velocity is approximately 202 feet/sec. The Reynolds number, Re, is defined as $$Re=\rho UL/\mu$$

where ρ is the fluid density and $\mu$ is the fluid viscosity. The Reynolds number provides the ratio of inertial and viscous effects in the flow. For this particular case, $Re=1.4\times10^7$ at the standard operating temperature of the kiln 10. The boundary layer 222 preferably grows along the interior wall 140 to a thickness such that the boundary layer fills the gap between the blade tips 218 and the interior wall 140.

The important parameter for quantifying the thickness of the boundary layer 222 at the blade tips 218 is known as the momentum thickness, θ. A method to estimate the momentum thickness θ is provided by Schlichtings formula where the momentum thickness for a turbulent boundary layer is given as $$\theta=0.036\ L(Re)^{31\ 1/5}$$

Using this estimate and the value for "L" and "Re" provided above, the momentum thickness θ, or more specifically the thickness of the boundary layer 220, at the blade tips 218 is approximately 0.26 inches. As alluded to above, the gap between the blade tips 218 and the interior wall 140 is approximately 0.25 inches. That is, the inlet distance "d9" has been selected in view of expected velocities to produce a boundary layer thickness that is approximately equal to, and not substantially larger than, the gap between the blade tips 218 and the interior wall 140.

In accordance with another aspect of the kiln 10, operation of the fans 20 is optimized by providing one or more constricting regions proximate the inlets of the fans and one or more expanding regions proximate the outlets of the fans. Stated differently, one or more constrictions to the recirculating flow path 204 are provided on the low-pressure sides of the fans 20, and one or more expansions to the recirculating flow path are provided on the high-pressure sides of the fans. In accordance with the illustrated embodiment of the present invention, the protrusions 78, 84, 96, 100 of the upper and lower plenums 64, 66 and the right and left openings 144, 146 of the circulation passages 138 provide such constrictions and expansions.

As best understood with reference to FIG. 1, the front protrusions 78, 96 of the upper and lower plenums 64, 66 define a constriction to the recirculating flow path 204 proximate the inlets of the fans 20 so that airflow proximate the inlets of the fans is accelerated while the fans operate to provide counterclockwise flow along the recirculating flow path. In addition, the rear protrusions 84, 100 of the upper and lower plenums 64, 66 cooperate to define an expansion to the recirculating flow path 204 proximate the outlets of the fans 20 so that airflow proximate the outlets of the fans is decelerated while the fans operate to provide counterclockwise flow along the recirculating flow path. Likewise, the rear protrusions 84, 100 are constructed to define a constriction to the recirculating flow path 204 proximate the inlets of the fans 20 so that airflow proximate the inlets of the fans is accelerated while the fans are operated to cause clockwise flow along the recirculating flow path. The front protrusions 78, 96 are constructed to generally define an expansion to the recirculating flow path 204 proximate the outlets of the fans 20 so that airflow proximate the outlets of the fans is decelerated while the fans are operated to cause clockwise flow along the recirculating flow path.

As best understood with reference to the representative circulation passage 138 illustrated in FIG. 3, the right and left openings 144, 146 to the circulation passages are respectively shaped to provide constrictions to the recirculating flow path 204 proximate the inlets of the fans 20, so that airflow proximate to the inlets is accelerated, and expansions to the recirculating flow path proximate the outlets of the fans, so that airflow proximate the outlets is decelerated, while the fans are operated to provide counterclockwise flow along the recirculating flow path. Likewise, the right and left openings 144, 146 are respectively shaped to provide expansions to the recirculating flow path 204 proximate the outlets of the fans 20, so that airflow proximate the outlets is decelerated, and constrictions to the recirculating flow path proximate the inlets of the fans, so that airflow proximate the inlets is accelerated, while the fans are operated to provide clockwise flow along the recirculating flow path.

In accordance with another aspect of the kiln 10, mixing of the heated air within the upper portion of the chamber interior space 54 is facilitated by the arrangement of the nozzles 148, 150. The arrangement of the groups of left nozzles 150 illustrated in FIGS. 3–4 is generally representative of the arrangement of all of the right and left nozzles 148, 150 and will now be further described, in accordance with one embodiment of the present invention. The upper and lower groups of nozzles 150 includes eight nozzles that are arranged in an arc. It is within the scope of the present invention for the groups to contain more or less nozzles. Further, for each of the groups of nozzles 150, two of the nozzles can be characterized as being end nozzles because they are at the opposite ends of the group, and the other nozzles of the group can be characterized as being middle nozzles because they are between the end nozzles. The discharge axes 152 of the middle nozzles 150 are preferably directed at least partially toward, and most preferably they intersect, the rotational axis 214 of the impeller 212. As best understood with reference to FIG. 4, the discharge axes of the end nozzles 150 do not intersect the rotational axis 214 of the impeller 212, but they are preferably directed at least partially toward, and most preferably they intersect, the common horizontal plane in which all rotational axes 214 extend. A majority of the end nozzles 150 can be characterized as being "shared" by adjacent fans 20.

Whereas the discharge axes 152 of the middle and end nozzles 150 respectively intersect the rotational axis 214 and the common horizontal plane in which the rotational axes 214 extend, those angles of intersection are preferably significantly less than 45 degrees in general and are preferably approximately 12 degrees. These inward angles enhance the mixing of the hot gas introduced into the upper portion of the chamber interior space 54, but they also detract somewhat from the above described advantage of having the discharge axes 152 extend at least generally parallel to the rotational axes 214 of the fans 20. Accordingly, an advantageous balance between the advantages has been determined to be achieved with the above mentioned angle of approximately 12 degrees. In accordance with another embodiment of the present invention, the discharge axes 152 are not oriented inwardly with respect to the rotational axes 214 or the like such that the discharge axes are horizontally extending and parallel to the rotational axes 214.

In accordance with another aspect of the kiln 10, mixing of the heated air within the upper portion of the chamber interior space 54 is facilitated by virtue of the blades 216 of different fans 20 being configured differently. That is, some of the impellers 212 are rotated clockwise about their respective axes 214 to provide clockwise flow along the flow path 204, whereas other of the impellers are rotated counterclockwise about their respective axes to provide clockwise flow along the flow path. Likewise, some of the impellers 212 are rotated clockwise about their respective axes 214 to provide counterclockwise flow along the flow path 204, whereas other of the impellers are rotated counterclockwise about their respective axes to provide counterclockwise flow along the flow path.

In accordance with another aspect of the kiln 10, mixing of the heated air within the upper portion of the chamber interior space 54 is facilitated by virtue of elongate splitter plates (not shown) being positioned in the upper portion of the chamber interior space. The splitter plates are disclosed in U.S. Pat. No. 5,414,944, which is incorporated herein by reference.

In accordance with another aspect of the kiln 10, the flow through the charge 14 of lumber is at least partially balanced by virtue of the right edge 110 of the lower wall 62 of the lower plenum 66 extending laterally beyond the charge-receiving area. More specifically, the overhang of the lower plenum 66 that is provided by the placement of the right edge 110 allows the clockwise flow from the upper portion of the chamber interior space 54 to the lower portion of the chamber interior space 30 to make an efficient turn so that entry of the airflow into the charge 14 of lumber is more generally "straight-on," which promotes optimal airflow between the top layers of the charge of lumber. The right radius of curvature 104 and the right flange 118 also enhance this effect. In addition, the overhang of the lower plenum 66 that is provided by the placement of the right edge 110 functions to reduce a venturi-like effect that can be caused by upward airflow proximate the right-most top edge of the charge 14 of lumber. Left unchecked, the up-flow can draw a considerable flow through upper layers of the right-most stack of lumber, which can cause too rapid drying of those upper layers. The overhang provided by the right edge 110 reduces the venturi-like effect by moving the up-flow away from the charge 14 of lumber. Positioning the right side wall 46 the distance "d1" from the charge 14 of lumber also decreases the speed of the up-flow, which correspondingly decreases the venturi-like effect.

In accordance with another aspect of the kiln 10, the flow through the charge 14 of lumber is at least partially balanced by virtue of the left edge 112 of the lower wall 62 of the lower plenum 66 extending beyond the charge-receiving area. More specifically, the overhang of the lower plenum 66 that is provided by the placement of the left edge 112 allows the counterclockwise flow from the upper portion of the chamber interior space 54 to the lower portion of the chamber interior space 30 to make an efficient turn so that entry of the airflow into the charge 14 of lumber is more generally "straight-on," which promotes optimal airflow between the top layers of the charge of lumber. The left radius of curvature 106 and the left flange 120 also enhance this effect. In addition, the overhang of the lower plenum 66 that is provided by the placement of the left edge 112 functions to reduce a disadvantageous venturi-like effect that can be caused by upward airflow proximate the left-most top edge of the charge 14 of lumber. Positioning the left side wall 48 the distance "d1" from the charge 14 of lumber also decreases the venturi-like effect.

In accordance with one example, after a charge 14 of green lumber has been dried within the lower portion of the chamber interior space 30, at least the rear doors 44 are opened and the dried charge of lumber is removed from the lower portion of the chamber interior space through the rear door opening 42.

The above and other aspects of the kiln 10 are advantageous because they are pertinent to either the efficient construction of, the efficient operation of, or timely operation of the kiln.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A kiln for drying a charge of lumber, the kiln comprising:

a kiln chamber defining a chamber interior space capable of receiving the charge of lumber for drying;

a plenum system in communication with the chamber interior space, the plenum system comprising:

a lower plenum, and an upper plenum positioned above the lower plenum; a duct system comprising:

an upper duct that is connected to and in communication with the upper plenum and is capable of directing heated air to the upper plenum so that the plenum system is capable of supplying heated air to chamber interior space, and a lower duct that is connected to and in communication with the lower plenum and is capable of directing heated air to the lower plenum so that the plenum system is capable of supplying heated air to chamber interior space; and an air moving device capable of circulating heated air supplied to the chamber interior space.

2. A kiln according to claim 1, further comprising a furnace capable of providing heated air, wherein the duct system is connected to and in communication with the furnace.

3. A kiln according to claim 1, wherein the plenum system further comprises an intermediate plenum positioned between and in communication with both the upper and lower plenums, wherein the intermediate plenum is capable of receiving heated air from both the upper and lower plenums, and wherein the intermediate plenum comprises outlets that are capable of supplying heated air from the intermediate plenum to the chamber interior space.

4. A kiln according to claim 1, wherein:

the kiln chamber comprises:

a lower chamber portion defining a lower portion of the chamber interior space that is capable of receiving the charge of lumber for drying, and an upper chamber portion positioned above the lower chamber portion and defining an upper portion of the chamber interior space;

the plenum system is at least partially positioned in the upper portion of the chamber interior space; and the air moving device is capable of circulating the heated air supplied to the chamber interior space at least through the lower portion of the chamber interior space.

5. A kiln for drying a charge of lumber, the kiln comprising:

a kiln chamber defining a chamber interior space capable of receiving the charge of lumber for drying;

a plenum at least partially positioned in the chamber interior space and comprising:

a plurality of outlets in communication with the chamber interior space, and opposite ends, wherein the plenum extends in a longitudinal direction between the ends, opposite longitudinally extending first and second sides that are displaced from one another in a lateral direction that is generally perpendicular to the longitudinal direction, and a plurality of circulation passages that extend generally laterally through the plenum, wherein each circulation passages defines opposite open ends that are open to the chamber interior space and are respectively proximate the laterally opposite sides of the plenum;

a furnace capable of providing heated air to the plenum so that the plenum is capable of supplying heated air to the chamber interior space via the outlets; and a plurality of air moving devices capable of circulating the heated air supplied to the chamber interior space to define a recirculating flow path that extends through the circulation passages.

6. A kiln according to claim 5, wherein:

the plenum defines an interior space, and each of the circulation passages defines an interior space that is discontiguous with the interior space of the plenum, whereby the circulation passages do not function as outlets from the interior space of the plenum.

7. A kiln according to claim 5, wherein:

the kiln chamber comprises:

a lower chamber portion defining a lower portion of the chamber interior space that is capable of receiving the charge of lumber for drying, and an upper chamber portion positioned above the lower chamber portion and defining an upper portion of the chamber interior space;

the plenum is at least partially positioned in the upper portion of the chamber interior space; and the air moving devices are capable of circulating the heated air supplied to the chamber interior space so that the recirculating flow path also extends through the lower portion of the chamber interior space.

8. A kiln according to claim 5, wherein the plenum further comprises a lower section positioned below the circulation passages and the circulation passages extend generally horizontally so that the flow path extends generally around the lower section.

9. A kiln according to claim 5, wherein the outlets are arranged so that for each circulation passage a first group of the outlets are arranged at least partially around the circulation passage.

10. A kiln according to claim 9, wherein:

each air moving device comprises an impeller positioned in a respective circulation passage of the plurality of circulation passages and each impeller defines a rotational axis; and for each circulation passage a majority of the first group of outlets arranged generally around the circulation passage are nozzles defining discharge axes that are directed at least generally parallel to the rotational axis of the impeller within the circulation passage, whereby mixing of the heated air supplied by the nozzles is promoted.

11. A kiln according to claim 9, wherein:

each air moving device comprises an impeller positioned in a respective circulation passage of the plurality of circulation passages and each impeller defines a rotational axis; and for each circulation passage a majority of the first group of outlets arranged generally around the circulation passage are nozzles defining discharge axes that are directed at least partially toward the rotational axis of the impeller within the circulation passage, whereby mixing of the heated air supplied by the nozzles is promoted.

12. A kiln according to claim 9, wherein for each circulation passage the first group of outlets arranged at least partially therearound are mounted to the first longitudinal side of the plenum.

13. A kiln according to claim 12, wherein for each circulation passage a second group of the outlets are mounted to the second longitudinal side of the plenum and are arranged at least partially around the circulation passage.

14. A kiln according to claim 13, wherein:

the air moving devices are capable of operating:

in a first mode so that the recirculating flow path extends in a first direction through the circulation passages, and in a second mode so that the recirculating flow path extends in a second direction through the circulation passages that is opposite from the first direction; and the kiln further comprises a control system that is operative so that:

for each circulation passage the first group of outlets supply heated air from the plenum to the chamber interior space and any amount of heated air supplied from the plenum to the chamber interior space via the second group of outlets is substantially less than the amount of heated air supplied from the plenum to the chamber interior space via the first group of outlets while the air moving devices are operating in the first mode, and for each circulation passage the second group of outlets supply heated air from the plenum to the chamber interior space and any amount of heated air supplied from the plenum to the chamber interior space via the first group of outlets is substantially less than the amount of heated air supplied from the plenum to the chamber interior space via the second group of outlets while the air moving devices are operating in the second mode.

15. A kiln according to claim 5, wherein each air moving device comprises an impeller positioned in a respective circulation passage of the plurality of circulation passages.

16. A kiln according to claim 15, wherein:

each impeller defines a rotational axis and comprises a plurality of blades extending radially away from proximate the rotational axis, and each blade comprises a blade tip that is distant from the rotational axis;

each circulation passage comprises an interior surface that extends around the rotational axis of the impeller within the circulation passage;

each impeller is capable of being operated to form a flow-induced boundary layer adjacent the interior surface of the circulation passage the impeller is within; and each impeller and the circulation passage the impeller is within are constructed so that the blade tips of the impeller extend at least to the flow-induced boundary layer adjacent the interior surface of the circulation passage while the impeller is operated, whereby bypass flow proximate the blade tips of the impeller is restricted.

17. A kiln according to claim 15, wherein:

for each circulation passage the flow-induced boundary layer extends for 360 degrees around the rotational axis extending through the circulation passage; and for each impeller the blade tips remain within the flow-induced boundary layer associated with the impeller as the blade tips rotate 360 degrees around the rotational axis of the impeller.

18. A kiln for drying a charge of lumber, the kiln comprising:

a kiln chamber defining a chamber interior space capable of receiving the charge of lumber for drying;

a plurality of air moving devices that are capable of operating in at least first and second modes, wherein:

the air moving devices provide a recirculating flow path within the chamber during both the first and second modes, flow along the recirculating flow path travels in a first direction while the air moving devices operate in the first mode, flow along the recirculating flow path travels in a second direction that is opposite from the first direction while the air moving devices operate in the second mode, and each of the air moving devices have opposite first and second sides that are respectively:

high and low-pressure sides during the first mode and, low and high-pressure sides during the second mode;

a furnace capable of providing heated air; and a communication system operative to provide heated air from the furnace to the high-pressure sides of the air moving devices so that any amount of heated air supplied from the furnace to the low-pressure sides of the air moving devices is substantially less than the amount of heated air supplied from the furnace to the high-pressure sides of the air moving devices during both the first and second modes of operation.

19. A kiln according to claim 18, wherein the furnace comprises a chamber in which fuel is combusted so that within the chamber air is heated and combustion by-products are created and mixed with the heated air, so that the heated air supplied from the furnace to the high-pressure sides of the air moving devices contains the combustion by-products.

20. A kiln according to claim 18, wherein the communication system comprises:

a plenum that receives heated air from the furnace and comprises:

a first group of outlets in communication with the chamber interior space and proximate the first sides of the air moving devices, and a second group of outlets in communication with the chamber interior space and proximate the second sides of the air moving devices; and a control system that is operative so that:

the first group of outlets supply heated air from the plenum to the chamber interior space and any amount of heated air supplied from the plenum to the chamber interior space via the second group of outlets is substantially less than the amount of heated air supplied from the plenum to the chamber interior space via the first group of outlets during the first mode, and the second group of outlets supply heated air to from the plenum to the chamber interior space and any amount of heated air supplied from the plenum to the chamber interior space via the first group of outlets is substantially less than the amount of heated air supplied from the plenum to the chamber interior space via the second group of outlets during the second mode.

21. A kiln according to claim 20, wherein:

the plenum comprises opposite first and second sides and a plurality of circulation passages that extend generally through the plenum, and each circulation passages defines opposite open ends that are open to the chamber interior space and respectively proximate the opposite first and second sides of the plenum;

the first group of outlets are arranged at least partially around the open ends of the circulation passages that are proximate the first side of the plenum;

the second group of outlets are arranged at least partially around the open ends of the circulation passages that are proximate the second side of the plenum; and each air moving device comprises an impeller positioned in a respective circulation passage of the plurality of circulation passages.

22. A kiln for drying a charge of lumber, the kiln comprising:

a kiln chamber defining a chamber interior space capable of receiving the charge of lumber for drying;

a furnace capable of providing heated air; and a plenum defining a plenum interior space capable of receiving heated air from the furnace and further capable of supplying the heated air received from the furnace to the chamber interior space, wherein the plenum comprises:

opposite ends, and the plenum extends in a longitudinal direction between the ends, opposite first and second walls that extend generally in the longitudinal direction between the opposite ends, wherein the first and second walls are displaced from one another in a lateral direction that is generally perpendicular to the longitudinal direction, each of the first and second walls comprises opposite first and second edges that extend generally in the longitudinal direction, and each of the first and second walls at least partially defines the plenum interior space, and a first protrusion proximate the first edge of the first wall and extending in the lateral direction away from both the first and second walls, wherein the first protrusion also extends in the longitudinal direction and at least partially defines the plenum interior space.

23. A kiln according to claim 22, wherein the first protrusion defines a radius of curvature.

24. A kiln according to claim 22, further comprising a second protrusion proximate the first edge of the second wall and extending in the lateral direction away from both the first and second walls, wherein the second protrusion also extends in the longitudinal direction and at least partially defines the plenum interior space.

25. A kiln according to claim 24, wherein:

the first edge of the first wall is positioned above the second edge of the first wall; and the first edge of the second wall is positioned above the second edge of the second wall.

26. A kiln according to claim 24, further comprising a third protrusion proximate the second edge of the first wall and extending in the lateral direction away from both the first and second walls, wherein the third protrusion also extends in the longitudinal direction and at least partially defines the plenum interior space.

27. A kiln according to claim 26, further comprising a fourth protrusion proximate the second edge of the second wall and extending in the lateral direction away from both the first and second walls, whereby in an end elevation view the plenum generally defines an I-like shape, and wherein:

the fourth protrusion at least partially defines the plenum interior space, and each of the protrusions extends in the longitudinal direction to the opposite ends of the plenum.

28. A kiln for drying a charge of lumber, the kiln comprising:

a kiln chamber defining a chamber interior space capable of receiving the charge of lumber for drying;

a plurality of air moving devices positioned in a parallel arrangement within the chamber interior space and capable of providing a flow path within the chamber interior space, wherein the parallel arrangement has opposite front and rear ends and extends in a longitudinal direction between the front and rear ends, each air moving device has opposite high and low-pressure sides and defines a flow axis, and the flow axes of the air moving devices extend generally in a common flow plane;

a longitudinally extending upper plenum positioned above the air moving devices and comprising longitudinally extending and opposite upstream and downstream protrusions; and a longitudinally extending lower plenum positioned below the air moving devices and comprising longitudinally extending and opposite upstream and downstream protrusions, wherein:

the upstream protrusions are positioned on opposite sides of the flow plane and extend divergently away from proximate the low-pressure sides of the air moving devices to define a constriction proximate the low-pressure sides of the air moving devices, whereby airflow entering the air moving devices is accelerated, and the downstream protrusions are positioned on opposite sides of the flow plane and extend divergently away from proximate the high-pressure sides of the air moving devices to define an expansion proximate the high-pressure sides of the air moving devices, whereby airflow exiting the air moving devices is decelerated.

29. A kiln according to claim 28, wherein:

the upper plenum defines an upper plenum cavity that extends into and is at least partially defined by the protrusions of the upper plenum; and the lower plenum defines a lower plenum cavity that extends into and is at least partially defined by the protrusions of the lower plenum.

30. A kiln according to claim 29, wherein the composite plenum further comprises an intermediate plenum that defines an intermediate plenum cavity that is in communication with both the upper and lower plenum cavities;

the intermediate plenum comprises a plurality of circulation passages that extend generally in a lateral direction through the intermediate plenum, wherein the lateral direction is generally perpendicular to the longitudinal direction, and each circulation passages defines opposite open ends that are open to the chamber interior space; and each air moving device comprises an impeller positioned in a respective one of the circulation passages.

31. A kiln for drying a charge of lumber, the kiln comprising:

a kiln chamber defining a chamber interior space and a charge-receiving space that is within the chamber interior space and is capable of receiving the charge of lumber for drying;

an air moving device capable of creating a flow path extending through the chamber interior space and through the charge-receiving space so that the charge-receiving space has opposite upstream and downstream sides;

a furnace capable of providing heated air;

a plenum in communication with the furnace and the chamber interior space so that the plenum is capable of receiving the heated air from the furnace and supplying heated air to the chamber interior space, wherein the plenum comprises a lower wall positioned above and proximate the charge-receiving space, and wherein:

the lower wall of the plenum comprises:

opposite ends, and upstream and downstream edges that extend generally in a longitudinal direction that extends between the ends, wherein the upstream and downstream edges are displaced from one another in a lateral direction that is generally perpendicular to the longitudinal direction, and the upstream edge of the lower wall of the plenum extends laterally beyond the upstream side of the charge-receiving space and the downstream edge of the lower wall of the plenum extends laterally beyond the downstream side of the charge-receiving space so that in a bottom plan view the entire charge-receiving space is positioned between the upstream and downstream edges of the lower wall of the plenum, whereby flow respectively into and out of upper portions of the upstream and downstream sides of an upper portion of the charge-receiving space is restricted by the lower wall of the plenum.

32. A kiln according to claim 31, further comprising:

a longitudinally extending, concave, downstream flange proximate the downstream edge of the lower wall of the plenum so that flow into the downstream side of the upper portion of the charge-receiving space is restricted; and a longitudinally extending, concave, upstream flange proximate the upstream edge of the lower wall of the plenum so that flow into the upstream side of the upper portion of the charge-receiving space is restricted.

33. A kiln for drying a charge of lumber, the kiln comprising:

a kiln chamber defining a chamber interior space capable of receiving the charge of lumber for drying;

a plenum defining a plenum interior space having a volume that is at least approximately as large as the volume of the charge of lumber;

a furnace that is operative for providing a heated air to the plenum so that the plenum is capable of supplying heated air to the chamber interior space; and an air moving device capable of circulating the heated air supplied to the chamber interior space.

34. A kiln according to claim 33, wherein:

the kiln chamber comprises:

a lower chamber portion defining a lower portion of the chamber interior space that is capable of receiving the charge of lumber for drying, and an upper chamber portion positioned above the lower chamber portion and defining an upper portion of the chamber interior space;

the plenum is at least partially positioned in the upper portion of the chamber interior space and supplies at least some of the heated air to the upper portion of the chamber interior space; and the kiln further comprises a plurality of reheater conduits connected to and in communication with the plenum, wherein the reheater conduits extend into the lower portion of the chamber interior space and supply at least some of the heated air from the plenum to the lower portion of the chamber interior space.

35. A kiln for drying a charge of lumber, the kiln comprising:

a kiln chamber defining a chamber interior space capable of receiving the charge of lumber for drying;

a furnace capable of providing heated air;

a communication system operative to provide heated air from the furnace to the chamber interior space; and an air moving device capable of circulating air within the chamber interior space, the air moving device comprising:

an impeller having a diameter and defining a rotational axis, and a shroud extending around the impeller and the rotational axis, wherein the shroud defines an inlet opening through which air is drawn into the impeller, an inlet distance is defined between the inlet opening and the impeller, and the inlet distance divided by the diameter of the impeller is at least approximately 0.167.

36. A method of assembling a kiln chamber of a kiln for drying a charge of lumber, the method comprising:

at least partially forming a lower chamber portion of the kiln chamber by at least positioning first and second walls so that at least one of the first and second walls is positioned on a slab, so that a distance is defined between the first and second walls, and so that the first and second walls are generally upstanding;

lowering a plenum onto the first and second walls so that the plenum extends generally between the first and second walls, the plenum is supported by the first and second walls, the plenum is suspended above the slab, and the lower chamber portion defines a lower space positioned below the plenum and capable of receiving the charge of lumber for drying; and mounting an enclosing structure to the plenum to at least partially form an upper chamber portion of the kiln chamber that is above the lower chamber portion and at least partially defines an upper space in which the plenum is at least partially positioned, wherein the enclosing structure is selected from the group consisting of walls and roofs.

37. A method according to claim 36, further comprising telescopically extending the plenum.

38. A kiln for drying a charge of lumber, the kiln comprising:

a kiln chamber defining a chamber interior space capable of receiving the charge of lumber for drying;

an outlet positioned in and in communication with the chamber interior space;

a furnace in communication with the outlet and capable of providing heated air to the outlet so that heated air is supplied to the chamber interior space via the outlet; and an air moving device positioned in the chamber interior space and comprising an impeller defining a rotational axis, wherein the air moving device is capable of rotating the impeller to move the heated air supplied to the chamber interior space along a flow path that at least initially extends generally along the rotational axis, and wherein the outlet defines a discharge axis along which the heated air supplied from the outlet at least initially flows, and the discharge axis is directed at least generally parallel to the rotational axis.

39. A kiln according to claim 38, further comprising a plenum, wherein the plenum is positioned between the furnace and the outlet so that the furnace is in communication with and capable of supplying the heated air to the plenum, and the plenum is in communication with and capable of providing heated air to the outlet so that heated air is supplied to the chamber interior space via the outlet.

* * * * *

UNITED STATES PATENT AND TRADEMARK OFFICE

CERTIFICATE OF CORRECTION

PATENT NO. : 6,467,190 B2
DATED : October 22, 2002
INVENTOR(S) : Nagel et al.

It is certified that error appears in the above-identified patent and that said Letters Patent is hereby corrected as shown below:

Title page,
Item [73], Assignee: "George R. Gulp" should read -- George R. Culp --.

Column 22,
Line 22, the formula should appear as follows:
-- $\theta = 0.036\ L(Re)^{-1/5}$ --

Signed and Sealed this

Eighteenth Day of February, 2003

JAMES E. ROGAN
*Director of the United States Patent and Trademark Office*